US010113732B2

(12) United States Patent
Loomis et al.

(10) Patent No.: US 10,113,732 B2
(45) Date of Patent: Oct. 30, 2018

(54) TREE TOPPER WITH TRUNK ATTACHABLE DEFORMABLE CONDUIT

(71) Applicant: Loominocity, Inc., Napa, CA (US)

(72) Inventors: Jason Loomis, Decatur, GA (US); Alexander B. Loomis, New York, NY (US); Ryan Seyffert, Bellingham, MA (US)

(73) Assignee: Loominocity, Inc., Napa, CA (US)

( * ) Notice: Subject to any disclaimer, the term of this patent is extended or adjusted under 35 U.S.C. 154(b) by 392 days.

(21) Appl. No.: 14/935,223

(22) Filed: Nov. 6, 2015

(65) Prior Publication Data

US 2016/0169494 A1 Jun. 16, 2016

Related U.S. Application Data

(63) Continuation of application No. 14/327,367, filed on Jul. 9, 2014, now Pat. No. 9,204,748, which is a (Continued)

(51) Int. Cl.
*F21V 23/06* (2006.01)
*A47G 33/08* (2006.01)
(Continued)

(52) U.S. Cl.
CPC ..... *F21V 23/06* (2013.01); *A47G 33/08* (2013.01); *A47G 33/10* (2013.01); *F21V 21/088* (2013.01); *F21V 21/32* (2013.01); *F21V 23/02* (2013.01); *A47G 2033/0827* (2013.01); *F21W 2121/04* (2013.01); *F21Y 2115/10* (2016.08)

(58) Field of Classification Search
CPC ..... F21V 23/00; F21V 23/06; F21V 23/02; F21V 21/088; F21V 21/32; A47G 33/08; A47G 33/10
See application file for complete search history.

(56) References Cited

U.S. PATENT DOCUMENTS 5,834,901 A * 11/1998 Shen ..... F21V 23/06 315/185 S
6,340,233 B1 * 1/2002 Shieh ..... A45B 3/04 135/910
(Continued)

*Primary Examiner* — Thai Pham
(74) *Attorney, Agent, or Firm* — Craige Thompson; Thompson Patent Law

(57) ABSTRACT

Apparatus and associated methods relate to a tree-top ornament apparatus configured to present a removeably attachable ornament above a top of a tree and supporting the presented ornament by clamping an ornament-connected deformable conduit to a secure portion of a tree trunk below the top of the tree. In an illustrative embodiment, the conduit may be deformable and yet semi-rigid so as not to deform under the weight of the presented ornament. In some embodiments, a sleeve may be configured to provide an electrical signal to a light emitting device for illuminating the ornament. The sleeve may include a light emitting device within a top hollow of the sleeve. In some embodiments, the light emitting device may be configured to illuminate a clear or semi-clear ornament received in the top hollow of the sleeve. The tree-top ornament apparatus may advantageously secure a tree-top ornament to the tree trunk at a location where the trunk is strong.

20 Claims, 22 Drawing Sheets

Related U.S. Application Data continuation-in-part of application No. 12/231,342, filed on Sep. 2, 2008, now Pat. No. 8,801,227, and a continuation-in-part of application No. 13/767,833, filed on Feb. 14, 2013, now Pat. No. 8,807,798, which is a continuation of application No. 12/986,066, filed on Jan. 6, 2011, now Pat. No. 8,398,269, said application No. 14/327,367 is a continuation-in-part of application No. 13/745,795, filed on Jan. 19, 2013, now Pat. No. 9,173,443, which is a continuation-in-part of application No. 13/288,114, filed on Nov. 3, 2011, now abandoned, which is a continuation-in-part of application No. 12/836,425, filed on Jul. 14, 2010, now Pat. No. 8,053,042, said application No. 14/327,367 is a continuation-in-part of application No. 13/426,577, filed on Mar. 21, 2012, now Pat. No. 9,113,515.

(60) Provisional application No. 60/967,026, filed on Sep. 1, 2007, provisional application No. 61/292,737, filed on Jan. 6, 2010, provisional application No. 61/225,258, filed on Jul. 14, 2009, provisional application No. 61/466,402, filed on Mar. 22, 2011.

(51) Int. Cl.

| | |
|---|---|
| ***A47G 33/10*** | (2006.01) |
| ***F21V 21/088*** | (2006.01) |
| ***F21V 21/32*** | (2006.01) |
| ***F21V 23/02*** | (2006.01) |
| *F21W 121/04* | (2006.01) |
| *F21Y 115/10* | (2016.01) |

(56) References Cited

U.S. PATENT DOCUMENTS

| | | | | |
|---|---|---|---|---|
| 6,422,891 | B1 * | 7/2002 | Huang | F21V 23/06 362/249.01 |
| 8,298,633 | B1 * | 10/2012 | Chen | A47G 33/06 248/512 |
| 8,376,584 | B1 * | 2/2013 | Jenko | F21S 4/15 362/123 |
| 2003/0045147 | A1 * | 3/2003 | Huang | F21V 23/06 439/226 |
| 2006/0164834 | A1 * | 7/2006 | Kao | A47G 33/06 362/249.01 |
| 2009/0128046 | A1 * | 5/2009 | Tsai | F21V 23/06 315/185 S |
| 2014/0334134 | A1 * | 11/2014 | Loomis | A41G 1/005 362/123 |

* cited by examiner

TREE TOPPER WITH TRUNK ATTACHABLE DEFORMABLE CONDUIT

CROSS-REFERENCE TO RELATED APPLICATIONS

This application claims the benefit and is a continuation of U.S. patent application Ser. No. 14/327,367, titled "Tree Topper with Trunk Attachable Deformable Conduit," filed by Jason Loomis on Jul. 9, 2014, which claims the benefit and is a continuation-in-part of U.S. patent application Ser. No. 12/231,342, titled "Illuminated Tree Top Ornament Apparatus," filed by Jason A. Loomis on Sep. 2, 2008, which claims the benefit of U.S. Provisional Application Ser. No. 60/967,026, titled "Illuminated Tree Top Ornament Apparatus," filed by Jason A. Loomis on Sep. 1, 2007.

The application also claims the benefit of U.S. patent application Ser. No. 13/745,795, titled "Architecture for Routing Multi-Channel Commands via a Tree Column," filed by Jason Loomis on Jan. 19, 2013, which claims the benefit and is a continuation-in-part of U.S. patent application Ser. No. 13/288,114, titled "Artificial Tree Apparatus with Axial Electrical Connectors," filed by Jason Loomis on Nov. 3, 2011, now abandoned, which claims the benefit and is a continuation-in-part of U.S. patent application Ser. No. 12/836,425, titled "Artificial Tree Apparatus," filed by Jason Loomis on Jul. 14, 2010, now U.S. Pat. No. 8,053,042, which claims the benefit of U.S. Provisional Application Ser. No. 61/225,258, titled "Artificial Tree Apparatus," filed by Jason A. Loomis on Jul. 14, 2009.

The application also claims the benefit of U.S. patent application Ser. No. 13/767,833, titled "Decorative Holographic Ornament," filed by Jason Loomis on Feb. 14, 2013, which claims the benefit and is a continuation of U.S. patent application Ser. No. 12/986,066, titled "Decorative Holographic Ornament," filed by Jason Loomis on Jan. 6, 2011, which claims the benefit of U.S. Provisional Application Ser. No. 61/292,737, titled "Decorative Holographic Sphere," filed by Jason Loomis on Jan. 6, 2010.

The application also claims the benefit of U.S. patent application Ser. No. 13/426,577, titled "Low Voltage Coupling Design," filed by Jiangmen Yi Xin Long on Mar. 21, 2012, which claims the benefit of U.S. Provisional Application Ser. No. 61/466,402, titled "Low Voltage Coupling Design," filed by Jiangmen Yi Xin Long on Mar. 22, 2011.

This application fully incorporates the disclosures of the following previously submitted applications by reference herein:

| Serial No. | Title | Filing Date |
|---|---|---|
| 14/327,367 | Tree Topper with Trunk Attachable Deformable Conduit | Jul. 9, 2014 |
| 12/231,342 | Illuminated Tree Top Ornament Apparatus | Sep. 2, 2008 |
| 60/967,026 | Illuminated Tree Top Ornament Apparatus | Sep. 1, 2007 |
| 13/745,795 | Architecture for Routing Multi-Channel Commands via a Tree Column | Jan. 19, 2013 |
| 13/288,114 | Artificial Tree Apparatus with Axial Electrical Connectors | Nov. 3, 2011 |
| 12/836,425 | Artificial Tree Apparatus | Jul. 14, 2010 |
| 61/225,258 | Artificial Tree Apparatus | Jul. 14, 2009 |
| 13/767,833 | Decorative Holographic Ornament | Feb. 14, 2013 |
| 12/986,066 | Decorative Holographic Ornament | Jan. 6, 2011 |
| 61/292,737 | Decorative Holographic Sphere | Jan. 6, 2010 |
| 13/426,577 | Low Voltage Coupling Design | Mar. 21, 2012 |
| 61/466,402 | Low Voltage Coupling Design | Mar. 22, 2011 |

TECHNICAL FIELD

Various embodiments relate generally to remote control of holiday lights.

Various embodiments relate generally to electrical lighting systems with configurable multi-channel architectures.

BACKGROUND

Holiday light displays are popular in today's culture. Many families set up elaborate holiday light displays. People tour the city in search of the best and most beautiful light displays. Neighbors may enjoy the competition of providing interesting and different holiday light displays. These displays may include crib scenes, decorated trees, stars, angels, Santa, and other display elements. Some lighting displays are multi colored and some are single colored. Some light displays are exterior to a home or a place of business. Such light displays may include environmentally tolerant lighting elements. Some light displays are interior displays. Some interior lighting displays include an artificial holiday tree.

Electrical energy can be generated at a generator and transported widely to supply electrical loads. As the energy is transported over great distances, the electrical energy may be in the form of a high potential voltage so that power can be delivered at correspondingly low currents to avoid resistive dissipation in the conductors. As the energy comes in proximity to the load, the voltage may be reduced to lower, safer levels. At the load, the electrical energy may be converted to some other form, such as heat, audible music, rotary motion, linear motion, or electromagnetic radiation.

Lights are one type of load that converts electrical energy to electromagnetic radiation. Visible light may result, for example, when electrical current flows through a resistive conductor causing the conductor to heat-up enough to glow. Visible light may also result when electric current arcs between terminals, as in an arc discharge lamp, or when electrons flow across a p-n junction, as in a light emitting diode (LED).

Individual light sources may be combined on a common load circuit that carries a common current so that a single current illuminates multiple light sources simultaneously. Such a load circuit may be referred to as a light string. In some applications, a light string load may include multiple load circuits connected in series and/or parallel.

SUMMARY

Apparatus and associated methods relate to a tree-top ornament apparatus configured to present a removeably attachable ornament above a top of a tree and supporting the presented ornament by clamping a ornament-connected deformable conduit to a secure portion of a tree trunk below the top of the tree. In an illustrative embodiment, the conduit may be deformable and yet semi-rigid so as not to deform under the weight of the presented ornament. In some embodiments, a sleeve may be configured to provide an electrical signal to a light emitting device for illuminating the ornament. The sleeve may include a light emitting device within a top hollow of the sleeve. In some embodiments, the light emitting device may be configured to illuminate a clear or semi-clear ornament received in the top hollow of the sleeve. The tree-top ornament apparatus may advantageously secure a tree-top ornament to the tree trunk at a location where the trunk is strong.

Apparatus and associated methods may relate to a tree embedded electrical signal distribution network for providing power and control signals to lighting elements associated with multiple independent control channels. In an illustrative embodiment, trunk segments of an artificial tree may have multiple control channels coupled therein. In some embodiments, mechanical connection of trunk segments may electrically connect corresponding control channels. In an exemplary embodiment, mechanical connection of a branch to a trunk segment may electrically connect a control channel coupled to the branch to one of the control channels of the trunk segment. In some embodiments, a switch associated with a branch connection may provide user selected association of one of the control channels coupled to the trunk segment to a control channel coupled to a branch coupled thereto. Some exemplary tree embedded electrical signal distribution networks may automatically be constructed by mechanically constructing an artificial tree.

Various embodiments may achieve one or more advantages. For example, some embodiments may provide a user lighting control of a holiday display from the comfort of a couch. In some embodiments, a lighting display may be remotely configured while one is away from home, for example.

Apparatus and associated methods relate to an electrical interface design architecture to independently excite each of a network of light strings and/or light string controllers with any of a number of independent excitation signals. In an illustrative example, each of the light strings may receive a selected one of the excitation signals conducted via a wiring assembly to an interface formed as a plug or a corresponding socket. In some embodiments, the interface may galvanically connect one or more of the excitation signals to a corresponding load according to user-selection of a relative orientation between the plug and the socket. In some implementations the load may include a down-stream controller that draws operating power through a selected one of the conductors at the interface. In various implementations, the interface may supply a load such as a multi-channel cable or single channel light string, for example.

In some examples, a transformer may split the power supply into four channels. Through the steady power (e.g., DC voltage) channel, power may be delivered to downstream controllers separated by a network of one or more linking wiring assemblies. Each wiring assembly may include one or more terminations. Each termination may include an electrical interface adapted to mate with any corresponding plug or socket in the network. In some examples, each interface may supply electrical excitation signals to substantially independent (e.g., electrically parallel) circuit branches.

In some examples, each channel of electrical excitation may be modulated to produce independent lighting effects on selected light string loads. The electrical excitation signals may include a substantially steady unipolar electrical excitation to power at least one downstream non-light string load and/or a light string (e.g., continuously on).

Various embodiments may achieve one or more advantages. For example, some embodiments may allow promote flexibility in design and placement of light strings operated simultaneously from independent electrical excitation signal channels. In some embodiments, the network architecture may substantially reduce the difficulty, time, expense while improving performance capabilities by supplying a network of light strings with a standardized set of wiring assemblies. The standardized interfaces with user-selectable interconnections may reduce or eliminate additional wiring to supply loads with multiple independent channels of electrical excitation. For example, an exemplary architecture may allow the excitation supplied to a light string to be selected from 1-of-N available excitation signals by the user simply unplugging the interface and adjusting the relative orientation of the plug and socket to any of N available positions. In some wiring assemblies, multiple terminations provide access to multiple channels for multiple single-channel light strings. In addition, some embodiments may be connected in series and parallel networks via standardized interfaces to distribute multiple independent channels where they are needed with a single wiring assembly. Accordingly, some embodiments may reduce cost and simplify creation of sophisticated lighting effects in different locations, such as in a retail store environment, within a water fountain display, or around various bushes or trees to decorate a yard with light strings.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
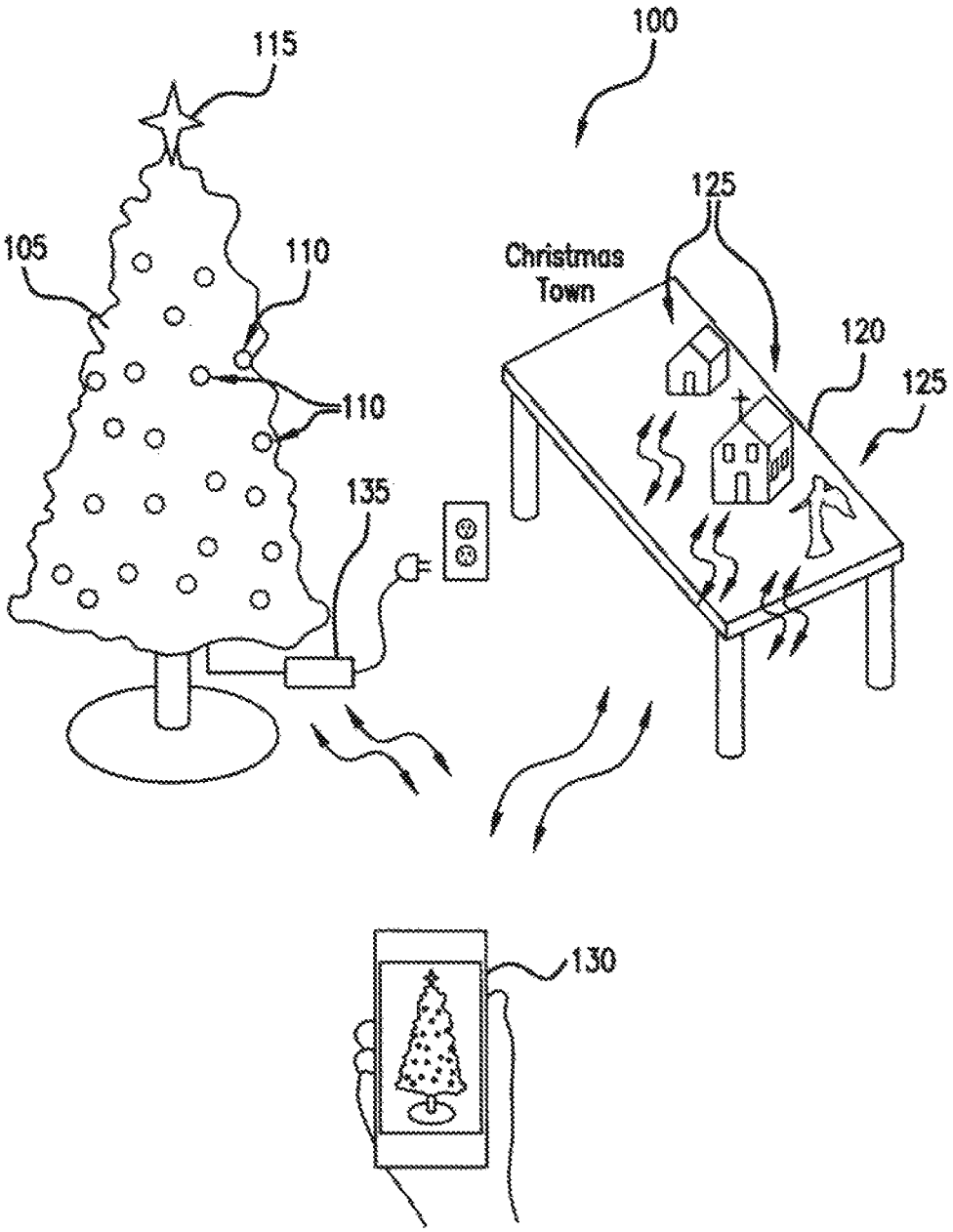
FIG. 1 depicts an exemplary remotely controlled Christmas display illumination system.

FIG. 1 depicts an exemplary remotely controlled holiday display system. In FIG. 1, a room 100 has been decorated for a celebration of a holiday. A holiday tree 105 has been set up and decorated with tree lights 110 and a tree-top ornament 115. A table 120 has been decorated with Christmas town figures 125. Each of the Christmas town figures 125 may have light elements and/or other controllable features that may be remotely controlled and/or configured. A mobile device 130 is depicted as running an app configured to provide remote control and/or remote configuration of the tree lights 110 and/or the tree-top ornament 115. The app may also be configured to control and or configure the various town figures 125. The tree lights 110 may be locally controlled by a control module 135. Communication between the control module 135 and the mobile device 130 may be performed wirelessly. The control module, may then send control signals to one or more individual tree lights 110 via a distribution network coupled to the holiday tree 105. The tree lights 110 may illuminate in a way corresponding the control signal. For example, a light unit may illuminate as a particular hue. In some embodiments, the intensity of illumination change as a function of time (e.g. blink or increase in intensity). Some embodiments may advantageously provide remote control and/or configuration of holiday lighting displays.

In some embodiments, an app may send a signal to devices within range of the mobile device 130 the signal corresponding to request for remotely controllable devices to identify themselves. The app may then receive an identification signals from the responsive remotely controllable devices and then may make a list of identified remotely controllable devices. The app may then display the list of remotely controllable devices to a user. The app may then receive an input from the user, the input selecting one or more device for control. The app may present to the user a list of controllable modes and/or functions associated with the user selected device. The app may then receive the user's selection and/or input associated with a display mode and/or function. The app may then wirelessly transmit a control signals to a control module 135 associated with the selected device. The control module 135 may then send electrical signals corresponding to the display mode and/or function to the selected device or devices. The signals may be sent to individual light units and/or groups of light units and/or other control modules. via the distribution network coupled to the holiday tree 105. The signals may be send via the distribution network coupled to the holiday tree 105. The distribution network may include one or more electrical channels. For example, an artificial tree may have one or more electrical channel coupled to one or more trunk sections. In some embodiments, tree limbs may have one or more electrical channels. Electrical conductivity between a tree limb and a trunk section may be completed concurrently with mechanically coupling a tree limb to a channel section, for example.

The tree topper 115 depicted in FIG. 1 may be coupled to a top vertical branch of the tree 105 via a connection below a top of the top vertical branch. The top of the top vertical branch may be insufficient in strength to securely support a tree top ornament. The top vertical branch may be stronger at a location below the top of the top vertical branch. The tree topper 115 may have one or more light elements. The one or more light elements of the tree topper 115 may be electrically coupled to the one or more electrical channels in the tree 105.

In various embodiments, a power and signal distribution network may be embedded within an artificial tree. Various exemplary power and signal distribution networks have been described, for example, at [0044] and in FIG. 5 of U.S. patent application Ser. No. 13/288,114, titled "Artificial Tree Apparatus with Axial Electrical Connectors," filed by Jason Loomis on Nov. 3, 2011, the entire disclosure of which is hereby incorporated by reference. For example, in FIG. 1 of the '114 application, a multi segment tree trunk is depicted. In some embodiments, each of the tree trunk segments may have one or more electrical channels. When the tree trunk segments are mechanically connected to one another, an electrical coupler in each trunk may make electrical connection between corresponding electrical channels. In an illustrative example, two adjacent tree trunk segments may each have four electrical channels. When the adjacent tree trunk segments are mechanically connected, a first channel of a first tree trunk segment may be electrically coupled to a first channel of a second tree trunk segment. Also, corresponding second channels of the adjacent tree trunks may be electrically coupled in the same manner. A third and a fourth channel, respectively may be coupled as the first and second channels above.

In some embodiments, branches of artificial trees may each have one or more electrical channels coupled thereto. Various embodiments of connecting electrical channels in branches to electrical channels in tree trunks have been described, for example, at [0038-0042] and in FIGS. 3-4 of U.S. patent application Ser. No. 13/745,795, titled "Architecture for Routing Multi-Channel Commands via a Tree Column," filed by Jason Loomis on Jan. 19, 2013, the entire disclosure of which is hereby incorporated by reference. In the embodiment depicted in FIGS. 3-4 of the '795 application, branch/trunk connections are shown. In some embodiments a branch may have a single electrical channel. Such a single channel branch may couple to one of the channels in a trunk segment when the branch is mechanically connected to the trunk segment. In some embodiments, a branch may have two or more electrical channels. Such multi-channel branches may couple one or more of the channels in the branch to one or more channels in the trunk segment to which the branch is mechanically connected.

In some embodiments, signal and power distribution networks are established simultaneous with the mechanical construction of an artificial tree. In some embodiments, the signal and power distribution network is fixed, wherein a branches electrical channel configuration is fixed by its mechanical location. In some embodiments, the signal and power distribution network of a branch may be configured independently of the branches mechanical position. For example, in some embodiments, a selection switch associated with a branch may select one or more electrical channels for branch connection from a plurality of trunk channels. In some embodiments, the branch channel configuration may be performed using an electrical signal, for example. In some embodiments, each light element may independently be assigned or associated with a channel. In an exemplary embodiment each light element may be independently addressable.

Various control modes and/or control functions may be performed. For example, in some embodiments, a wave of color be displayed at the top of a tree. The color may then slowly begin being displayed to lower regions of the tree, until the wave of color is displayed by the lighting elements located at the bottom of the tree. Such a coordinated display may be done by a controller sending a time sequenced series of commands to individual light element controllers. In some embodiments, each light element may have a controller coupled thereto. For example, each light element/controller may be coupled to a common control bus. Each light element may, for example, be a slave on the bus, listening for an address corresponding to the light element. When a light element detects that light elements address, a command associated with the transmission containing the address may be received by that light element. The received transmission may include a lighting command for that particular light element. The light element may then perform the commanded function. For example, a light element may change its illumination color in response to receiving a color-change command. In an exemplary embodiment, a light element may change its light intensity in response to an intensity-change command. In some embodiments a turn-on or turn-off command may be received by a light element.

In some embodiments, the electrical distribution network may include power or may even only be a power distribution network. In some embodiments, each lighting element may include a wireless receiver for receiving control transmissions, for example. In an exemplary embodiment, a single pair of conductors may carry both power and control signals. For example a power and signal distribution network may include a positive power line and a negative power line. A control signal may modulate the voltage difference between the positive power line and the negative power line, for example. Exemplary lighting control modules may decode control signal modulation of the power line. The control module than may send local signals to lighting elements in response to the decoded control signals.

Figure 2:
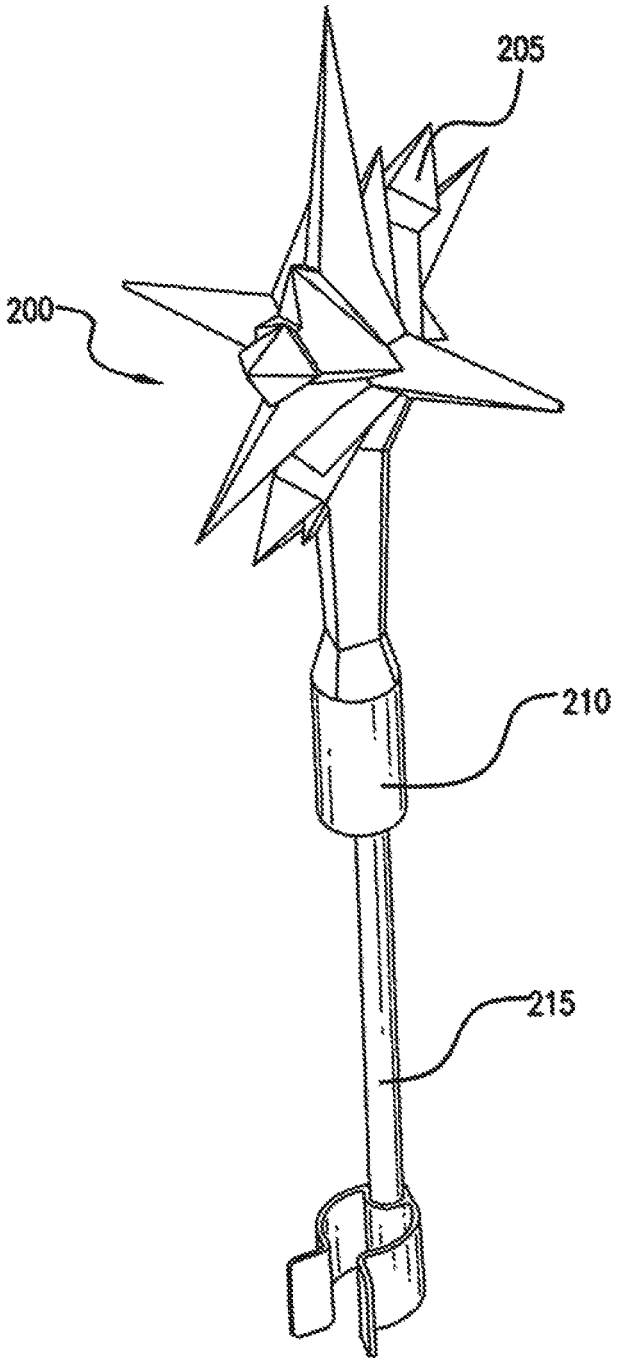
FIG. 2 depicts a perspective view of an exemplary tree topper with trunk attachable deformable conduit.

FIG. 2 depicts a perspective view of an exemplary tree topper with trunk attachable deformable conduit. In FIG. 2, an exemplary tree topper device 200 includes an ornament 205 coupled to a sleeve 210. The sleeve 210 is supported by a deformable conduit 215. The deformable conduit 215 is configured to couple to a tree trunk at a location beneath the top of the tree trunk. The top of the tree trunk may be flexible and incapable of supporting the tree topper device 200. But at a distance beneath the top of the tree trunk, the trunk may be less flexible and may be more capable of supporting the tree topper device 200. For example, the very top of the trunk of a real tree may be a new growth branch. The new growth branch may be relatively thin and flexible. But a short distance below the new growth may be the trunk portion associated with last year's growth. This portion may be less flexible and thicker than the top new growth portion. Again a short distance below this last year's growth portion may be two-year's ago growth portion of the tree trunk. This two-year's ago growth portion may be yet stronger and thicker than even last year's growth portion. Coupling a tree topper device to one of portions of the tree trunk that is below the top portion may provide the strength and/or inflexibility needed to secure the tree topper device to the tree.

In an artificial tree the top branch may be relatively week in comparison to the tree trunk to which it is connected. Connecting a tree topper device to the tree trunk may provide a more rigid connection than connecting the tree topper device to the top branch. The trunk connected tree topper device may advantageously reduce the danger of accidental falling of the tree topper device, for example. Connecting the tree topper device to a tree trunk may permit quick alignment of the tree topper device to the top branch.

Figure 3:
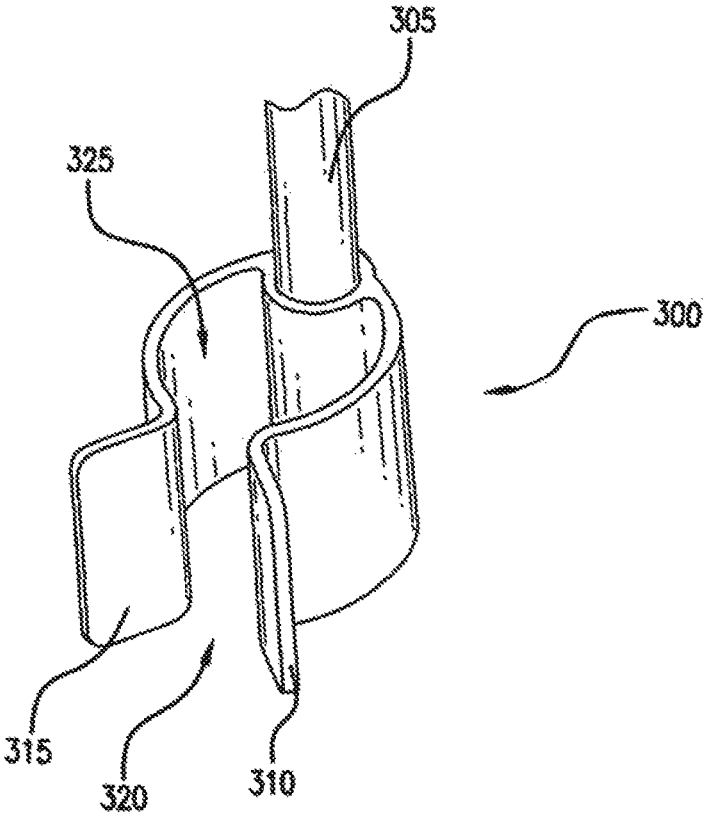
FIG. 3 depicts a close-up perspective view of an exemplary clip-style clamp for a tree topper with trunk attachable deformable conduit.

FIG. 3 depicts a close-up perspective view of an exemplary clip-style clamp for a tree topper with trunk attachable deformable conduit. In FIG. 3, a clip-style clamp 300 is coupled to a deformable conduit 305. The clip-style clamp may include two flexible lips 310, 315. The flexible lips 310, 315 may be opposed to one another. A tree trunk may be inserted into a vertical opening 320 between the two opposed flexible lips 310, 315. The two opposed flexible lips 310, 315 may deformable open to permit a trunk larger than the vertical opening to be received into a trunk reception cavity 325.

Figure 4:
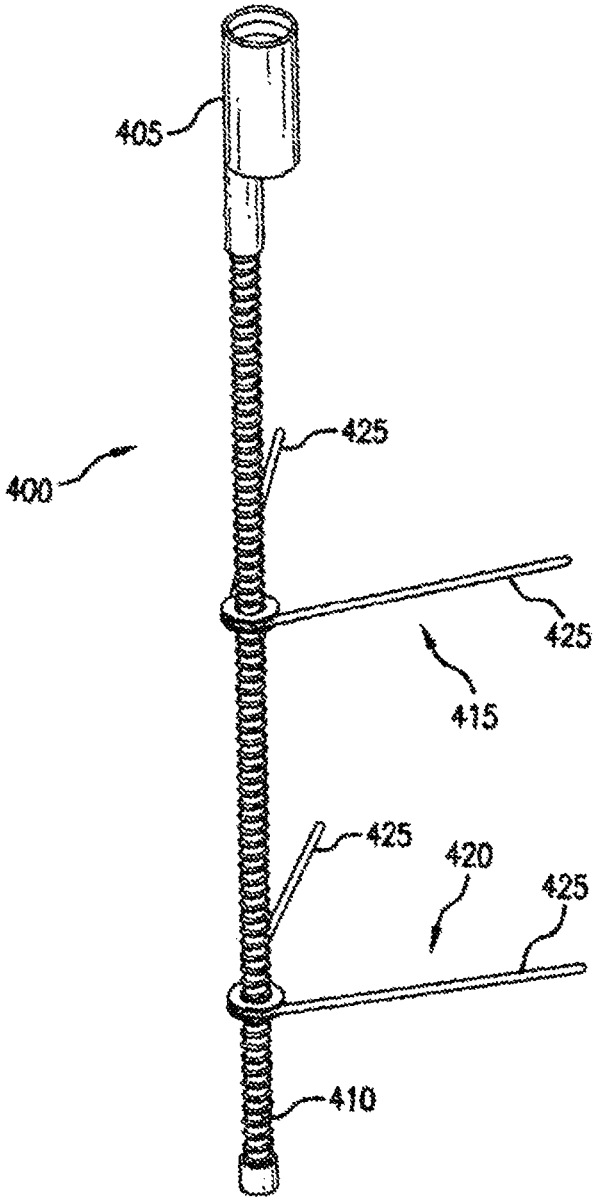
FIG. 4 depicts a perspective view of an exemplary tree topper with trunk attachable deformable conduit.

FIG. 4 depicts a perspective view of an exemplary tree topper with trunk attachable deformable conduit. In FIG. 4 an exemplary tree topper 400 includes an ornament sleeve 405 and a deformable conduit 410. Two twist-tie type of connectors 415, 420 are coupled to the deformable conduit 410. The deformable conduit 410 may a threaded exterior surface for example. Each of the twist-tie connectors 415, 420 may be spun on the threads to vertically locate each twist-tie connector 415, 420 at a desired position along the deformable conduit 410. Each of the twist-tie connectors is shown having two deformable arms 425 that can be wrapped around a tree trunk. After securing the tree topper 400 to the tree, the conduit may be deformed so as to align the ornament to the tree trunk, for example. A user may desire to axially align the ornament with the tree trunk for example. The conduit may be slightly offset axially from the tree trunk, and so an S-curve deformation may bring the ornament in axial alignment with the tree trunk.

Figure 5:
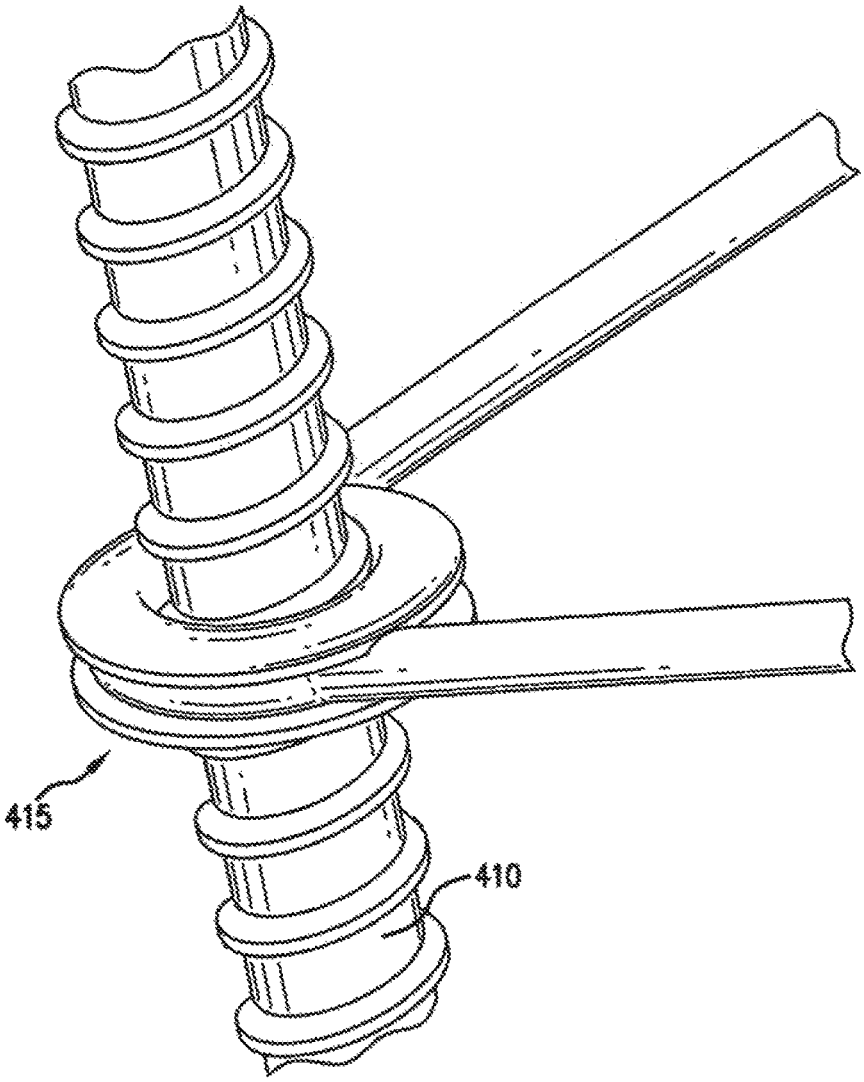
FIG. 5 depicts a close-up perspective view of an exemplary twist-tie clamp for a tree topper with trunk attachable deformable conduit.

FIG. 5 depicts a close-up perspective view of an exemplary twist-tie clamp for a tree topper with trunk attachable deformable conduit. In the FIG. 5 depiction the exterior surface of the deformable conduit 410 depicts the exterior thread described above. The twist-tie connector 415 may have threading corresponding to the exterior threading of the deformable conduit 410, for example.

Figure 6:
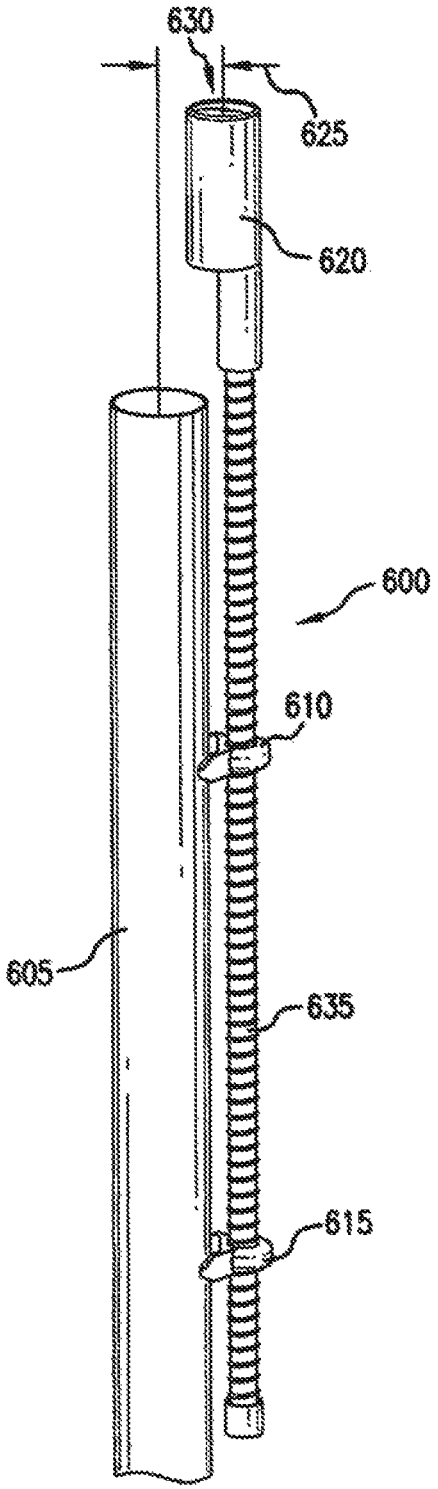
FIG. 6 depicts a perspective view of an exemplary tree topper with trunk attachable deformable conduit magnetically attached to an artificial tree trunk.

FIG. 6 depicts a perspective view of an exemplary tree topper with trunk attachable deformable conduit magnetically attached to an artificial tree trunk. In FIG. 6, a tree topper device 600 is shown attached to an artificial tree trunk 605. The artificial tree trunk 605 is depicted as a hollow tube. The artificial tree trunk 605 may contain magnetic material so as to be couple able to a magnet. The depicted tree topper 600 has two magnetic connectors 610, 615. Each of the magnetic connectors has alignment arms that have a coupling surface that tangentially receives a cylindrical trunk. An ornament sleeve 620 is presented at a vertical position above a top of the tree trunk 605. An axial separation distance 625 between the tree trunk 605 and an ornament receiving hollow 630 is depicted. S-shaped deformation of a deformable conduit 635 may bring the ornament receiving hollow into axial alignment with the tree trunk 605.

Figure 7:
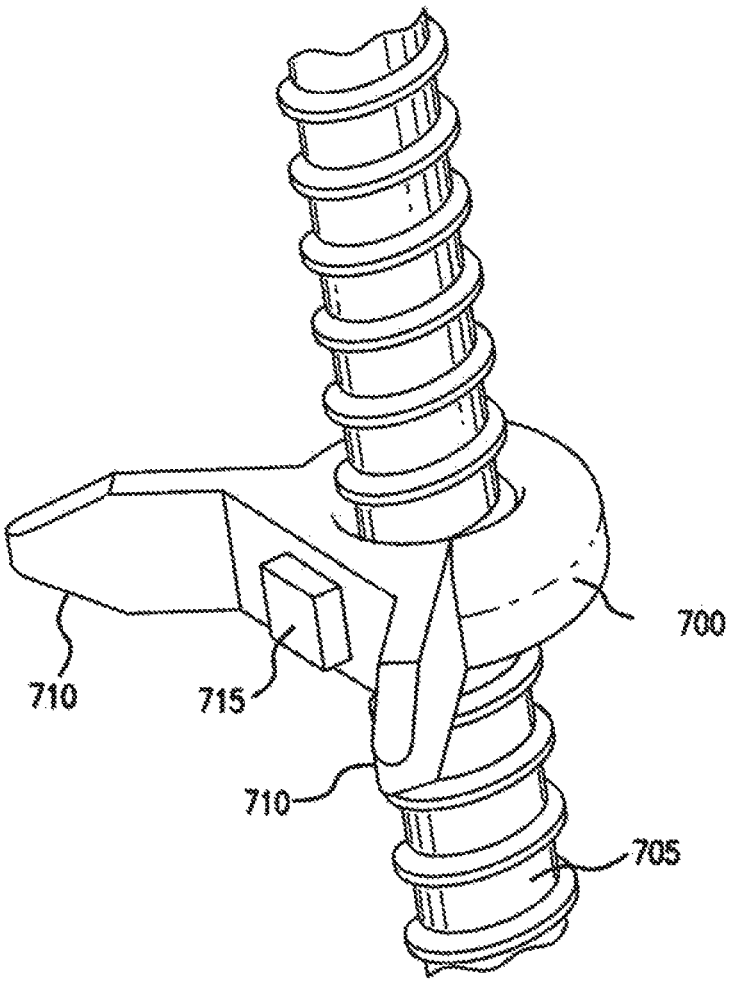
FIG. 7 depicts a close-up perspective view of an exemplary magnetic clamp for a tree topper system.

FIG. 7 depicts a close-up perspective view of an exemplary magnetic clamp for a tree topper system. In FIG. 7, an exemplary magnetic coupler 700 is shown attached to a deformable conduit 705. The magnetic coupler 700 includes two trunk receiving arms 710 and a magnet 715. The magnet 715 presents a tangential face to a received cylindrical tree trunk.

Figure 8:
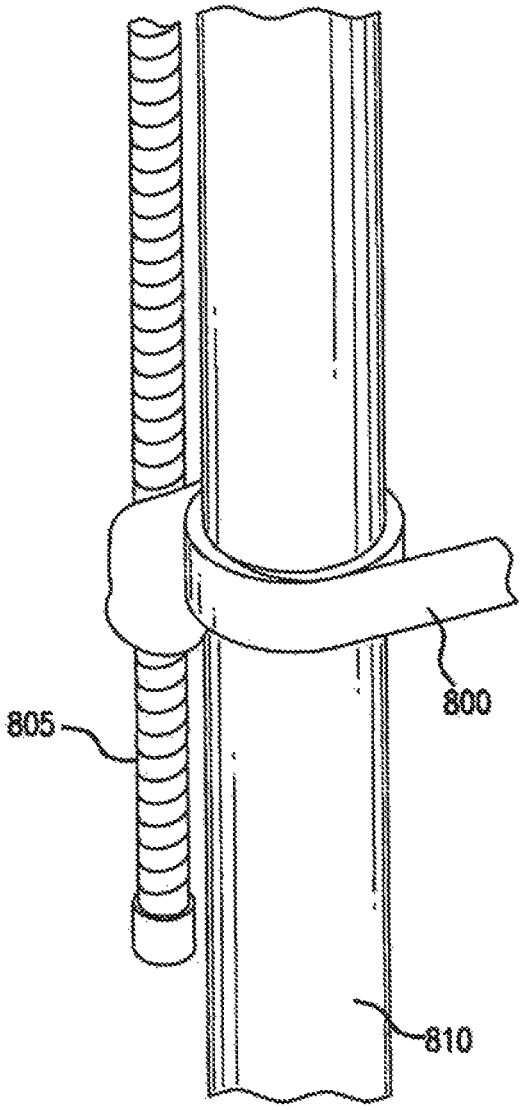
FIG. 8 depicts a perspective view of an exemplary tree topper with trunk attachable deformable conduit attached to an artificial tree trunk.
Figure 9:
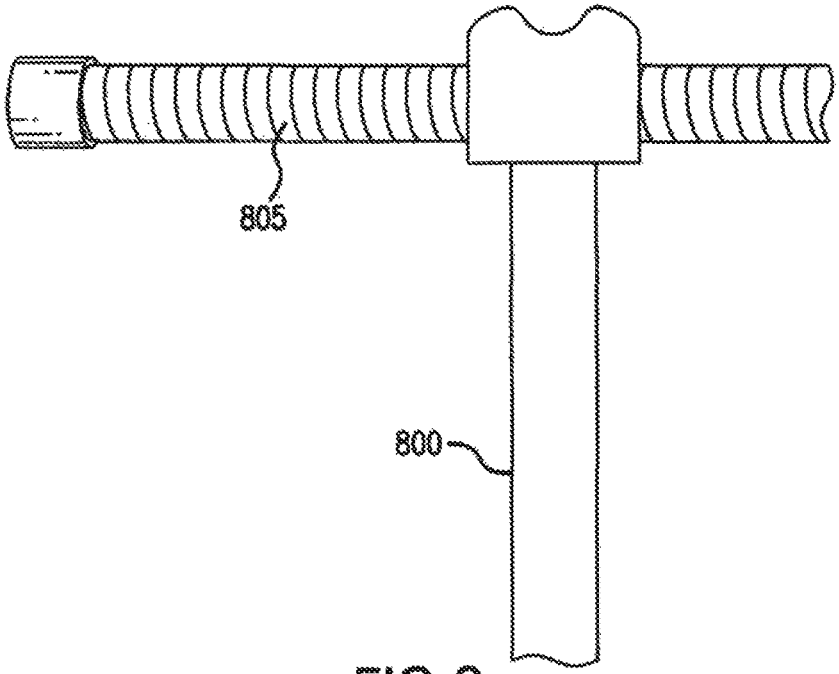
FIG. 9 depicts a close-up perspective view of an exemplary hook-and-loop clamp for a tree topper system.

FIGS. 8-9 depict perspective views of an exemplary tree topper with trunk attachable deformable conduit attached to an artificial tree trunk. In the FIGS. 8-9 depictions, an exemplary hook-and-loop style connector 800 is shown connected to a deformable conduit 805. The exemplary hook-and-loop style connector 800 may connect the deformable conduit 805 to a tree trunk 810.

Figure 11A:
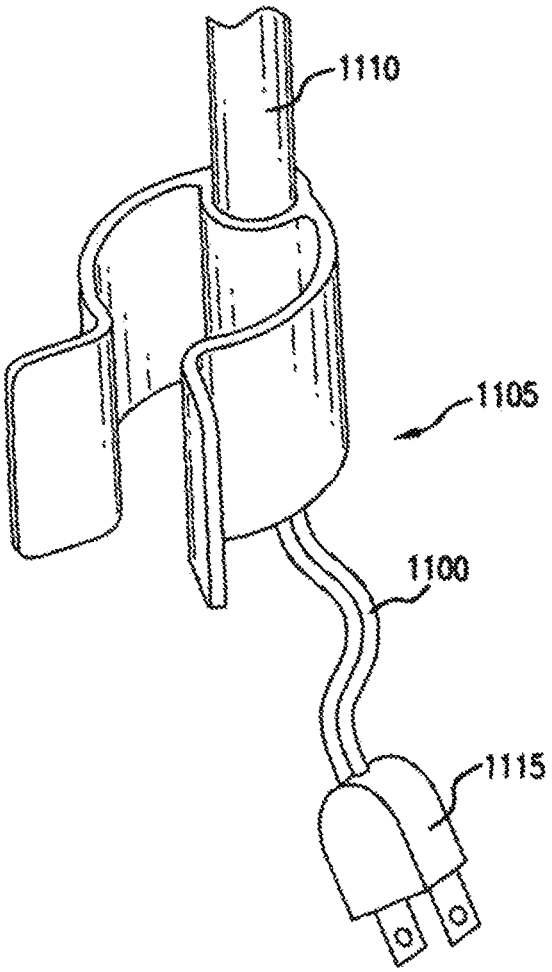
FIGS. 11A, 11B, and 11C depict schematic views of various tree top electrical connectors.
Figure 11B:
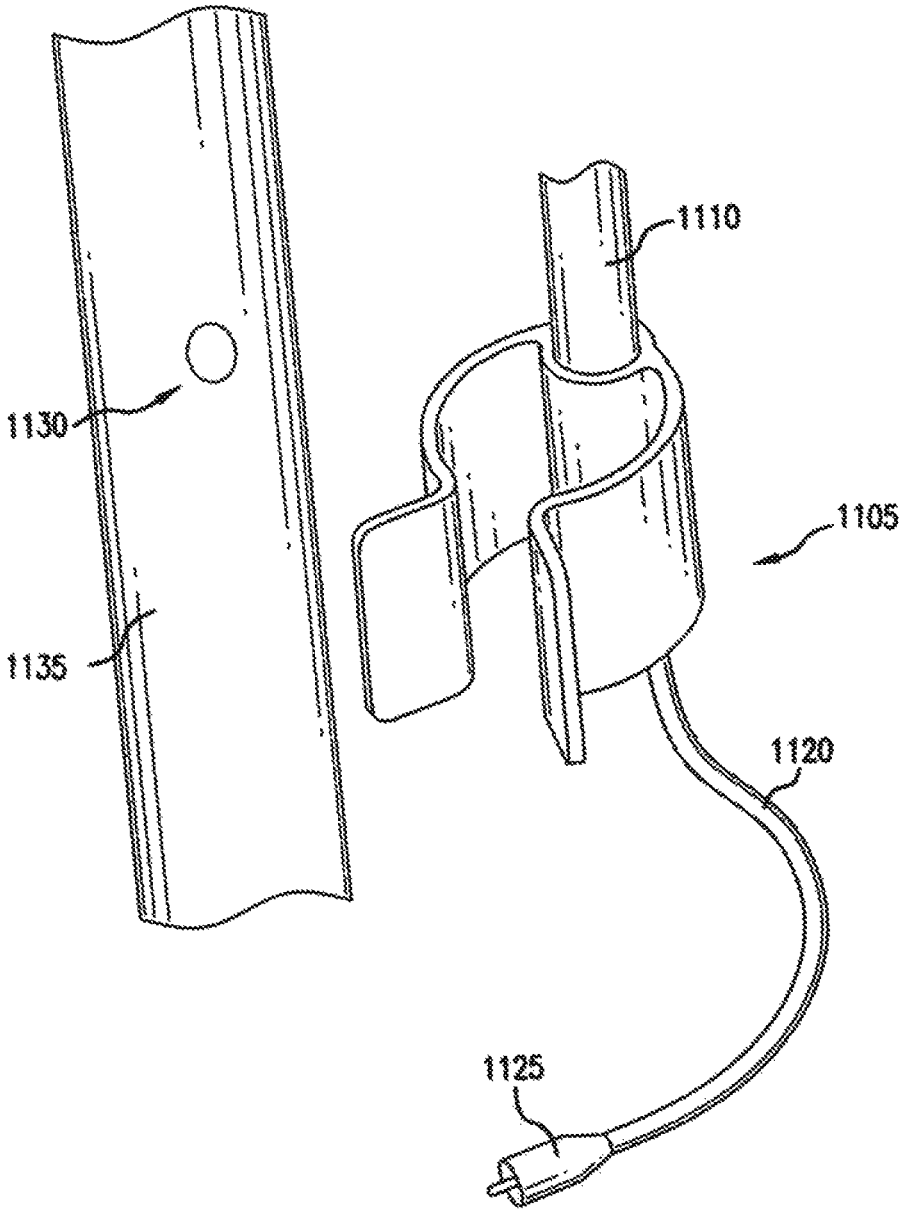
Figure 11C:
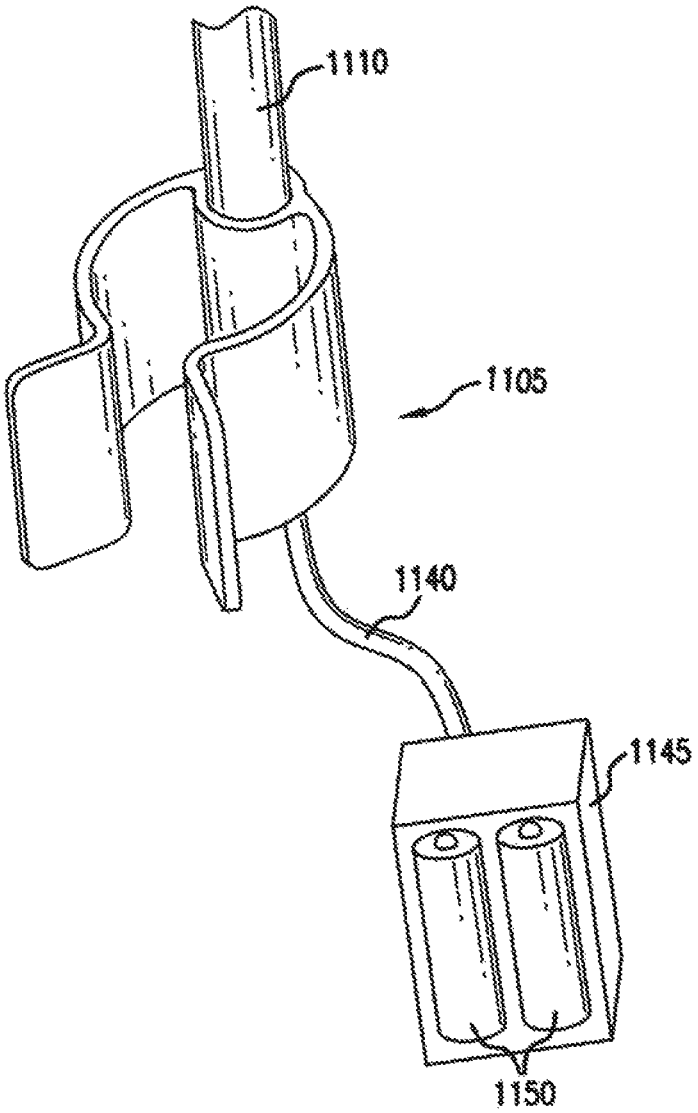

FIGS. 11A, 11B, and 11C depict schematic views of various tree top electrical connectors. In FIG. 11A, an electrical cord 1100 is shown emerging from a bottom end 1105 of a conduit 1110. The electrical cord 1105 is attached to an electrical plug 1115. In the depicted embodiment, the electrical plug 1115 may be configured to connect to an AC power outlet. In FIG. 11B, an electrical cord 1120 is shown emerging from the bottom end 1105 of the conduit 1110. An electrical connector 1125 is attached to the electrical cord 1120. The electrical connector 1125 may be configured to attach to a complementary connection port 1130 on a tree trunk segment 1125. In some embodiments, the tree trunk segment 1130 may have one or more electrical channels within. The connection port 1130 may electrically couple to one or more of the electrical channels. In FIG. 11C, an electrical cord 1140 is shown emerging from a bottom end 1105 of the conduit 1110. The electrical cord 1140 is connected to a battery holder 1145. In the depicted embodiment, the battery holder 1145 contains two batteries 1150. In some embodiments, an electrical connector may be configured to plug into a light socket of a light string. For example, a light element may be removed from a light string leaving an unused light socket. The light socket may then be used by an electrical connector for a tree top ornament system.

Although various embodiments have been described with reference to the Figures, other embodiments are possible. For example, in some embodiments, the conduit may provide passage for a power channel therethrough. In an exemplary embodiment, power and/or signal channels may be coupled to the conduit. In an exemplary embodiment, a coupler that connects a tree topper to a tree trunk may include a channel connector. For example, when the tree topper is mechanically connected to the tree trunk, one or more electrical channels in the tree topper may be connected to one or more channels of the tree trunk.

In some embodiments, one or more lighting element may be coupled to the ornament sleeve. The lighting element may be configured to illuminate a clear or semi-clear ornament received into the ornament sleeve, for example. In an illustrative embodiment, a sleeve may have an electrical channel coupler that provides connection between a channel in an ornament and a channel in the tree topper when an ornament is received in the hollow.

Various embodiments provide for releaseable connection of an ornament and a tree topper device. For example, in some embodiments, a hollow may receive an ornament. In an exemplary embodiment the sleeve may instead be a projection, upon which an ornament is positioned. In some embodiments an ornament connector is vertically presented at a top vertical surface for connection to an ornament.

In some embodiments, wireless transmission of lighting control may be performed using a mobile device. For example, a cell phone may run a lighting control app. In some embodiments, a tablet computer may run a lighting control program. Transmission between a mobile device a lighting system may be wireless. Various transmission protocols may be used when transmitting lighting commands. For example, transmission may be performed using Bluetooth and/or ZigBee and/or Wi-Fi, or other protocols. In some embodiments, IR light transmission of lighting controls may be used, for example. In some embodiments, transmission may be directly between lighting elements and a mobile device. In some embodiments, transmission may be from a mobile device to a control module, for example. In some embodiments, a lighting display may be controlled from a wireless router. In some embodiments, a control module may use wireless cellphone protocols for transmission. Control signals may be sent to such a control module via a phone call (and/or a text message), for example.

In various embodiments, various methods of controlling lighting elements may be used. Some such methods have been described, for example, at [0043-0048] and in FIG. 8 of U.S. patent application Ser. No. 13/426,577, titled "Low Voltage Coupling Design," filed by Jiangmen Yi Xin Long on Mar. 21, 2012, the entire disclosure of which is hereby incorporated by reference.

In various embodiments, various tree ornaments may be coupled to a holiday tree. For example, illuminated ornaments may be coupled to a power and control network of a tree. In some embodiments, a tree ornament may be coupled to a coupling site on a tree limb or on a tree trunk segment. In some embodiments, an ornament may couple to a light string. For example, in some embodiments, a lighted tree ornament may have a connector configured as a light element of a light string. For example, the connector may replace a light element and draw power from the light element's connector on the light string. In some embodiments, the tree ornament may be battery powered. In some embodiments, the tree ornament may draw power from the tree's power distribution network. In some embodiments, the tree ornament may receive control signals via the tree's control signal distribution network. In an exemplary embodiment, a tree ornament may receive control signals wireless (e.g. Bluetooth, ZigBee, Wi-Fi, etc.).

In various embodiments, various methods of providing power and control to illuminated holographic tree ornament may be used. Some such holographic tree ornaments have been described, for example, at [0007-0008 and 0013] and in FIG. 1 of U.S. patent application Ser. No. 13/767,833, titled "Decorative Holographic Ornament," filed by Jason Loomis on Feb. 14, 2013, the entire disclosure of which is hereby incorporated by reference.

The illuminated tree top ornament apparatus of the present invention provides a tree top ornament with one or an array of LED or other lights, with an attachment mechanism for releasable attachment to the top branch or trunk of artificial and natural trees. The lights are connected to a sleeve designed to fit over the top vertical branch of the tree, but which is supported by a rigid conduit that clamps to the tree branch some distance below the top, so that the top of the branch does not itself bear any of the tree top ornament's weight. The user may selectively attach a variety of clear and semi clear acrylic or glass ornamental tree toppers for illumination by the lights.

One problem with many natural and artificial trees is that the top of the tree often does not have the capacity to bear weight, making it difficult to place a tree top ornament. With the inventive design the user is able to clamp the apparatus onto the tree trunk some distance below the top of the tree (e.g., eighteen inches) at a point where the trunk is bigger, stronger, and more rigid.

It is therefore an object of the present invention to provide a new and improved lighting apparatus.

It is another object of the present invention to provide a new and improved illuminated tree top ornament.

A further object or feature of the present invention is a new and improved tree top ornament that can be used with either natural or artificial trees.

An even further object of the present invention is to provide a novel tree top ornament that permits placement of the ornament even on small or weak trees.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

Figure 10:
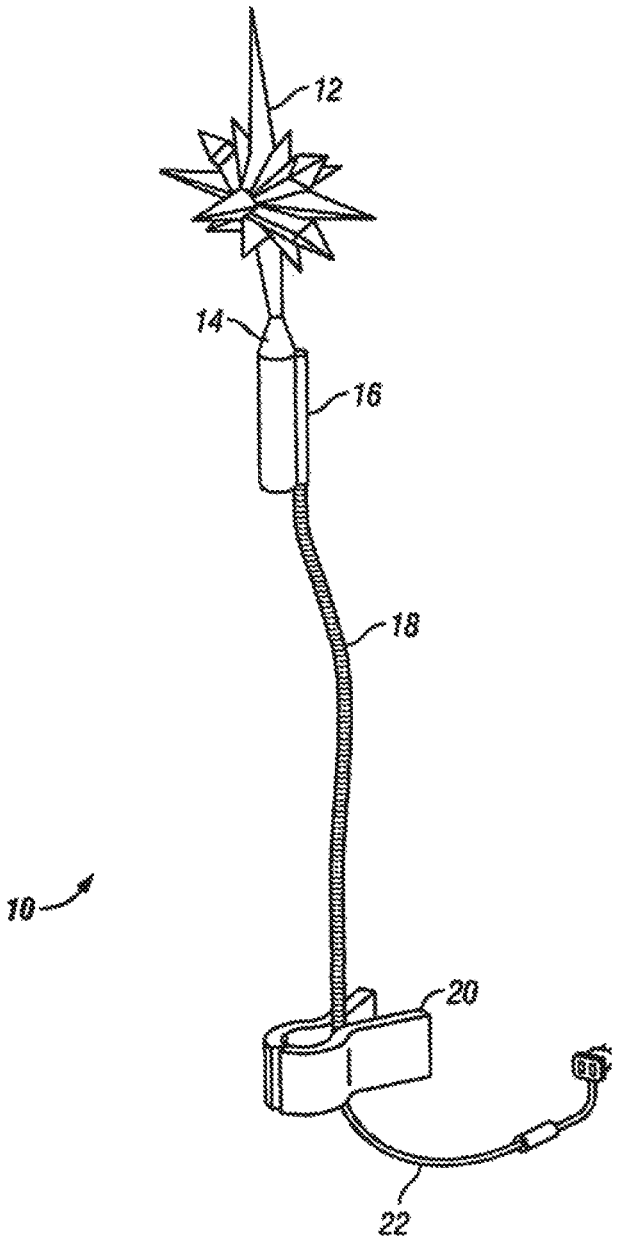
FIG. 10 is a front elevation view of an illuminated tree top ornament apparatus of this invention.

Referring to FIG. 10, there is illustrated therein a new and improved illuminated tree top ornament apparatus, generally denominated 10 herein. Apparatus 10 includes an ornament such as a star 12 attached to an LED or LED array 14, a sleeve 16 for placement on the end of a branch or tree trunk, a cable 18, a clamp 20, and electrical cord 22. The cable 18 is stiff (but may be deformable), and acts as a conduit for the cord 22 carrying the electricity to the LED light(s).

The adjustable cable/conduit 18 supports the sleeve 16, LED array 14 and ornament (e.g., star) 12. The sleeve 16 preferably includes a conical hollow **16*a* on the bottom which is designed to fit over the top vertical branch of the tree, but since it is supported by the rigid conduit 18** that clamps to the tree branch some distance below the top, the top of the branch does not itself bear any of the tree top ornament's weight.

The LED or other lights may be clear or of any color, or of variable color, to give the desired effect to the illuminated ornament. The sleeve, conduit, clamp, cord, and other visible components are preferably of a construction and color to blend with the tree.

A variation of the inventive apparatus provides a table top (or mantle, windowsill, or other surface) apparatus that illuminates the acrylic objects (e.g., star, angel). This table top LED array may be made in two versions and has two functions.

A first version is battery operated and may work on a 24 hour timer that turns on for 5 hours (or more or less) each day automatically. A second version utilizes a rechargeable battery that rests in home position on a charging plate, much like a wireless home phone, and can then be put on a dinner table or in a windowsill when desired. This version may also work on a 24 hour timer and turn on for a selected period each day automatically.

A first function of the inventive table top apparatus is the illumination of the acrylic pieces. A second function is that the apparatus can be used to illuminate a standard pillar candle (made of real wax). This allows the user to create a beautiful light effect in the candle material but they can use real candles that are actually lit.

Some aspects of embodiments may be implemented as a computer system. For example, various implementations may include digital and/or analog circuitry, computer hardware, firmware, software, or combinations thereof. Apparatus elements can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Some embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

Figure 18:
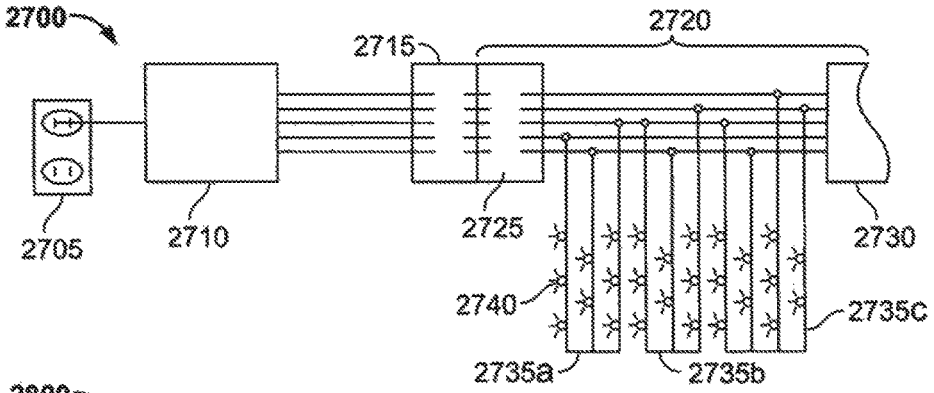
FIG. 18 depicts a schematic view of an exemplary network architecture using the interface of FIG. 12.
Figure 19:
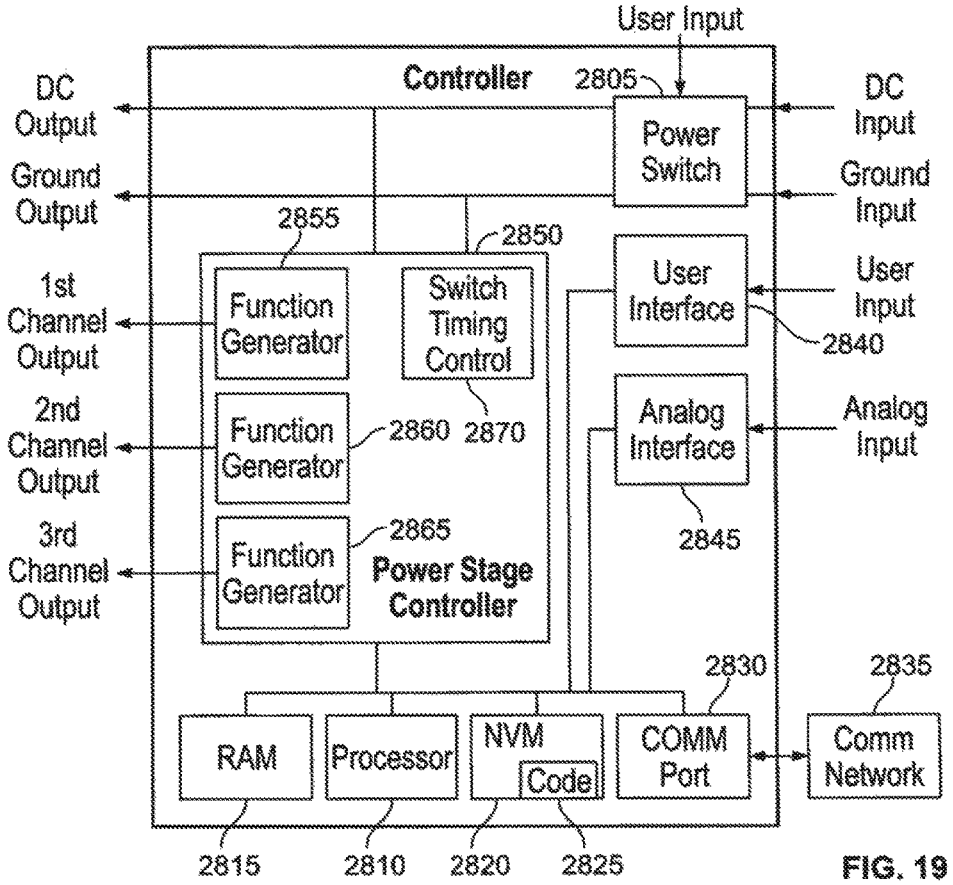
FIG. 19 depicts an exemplary controller implemented for outputting independent electrical excitation signals.
Figure 20:
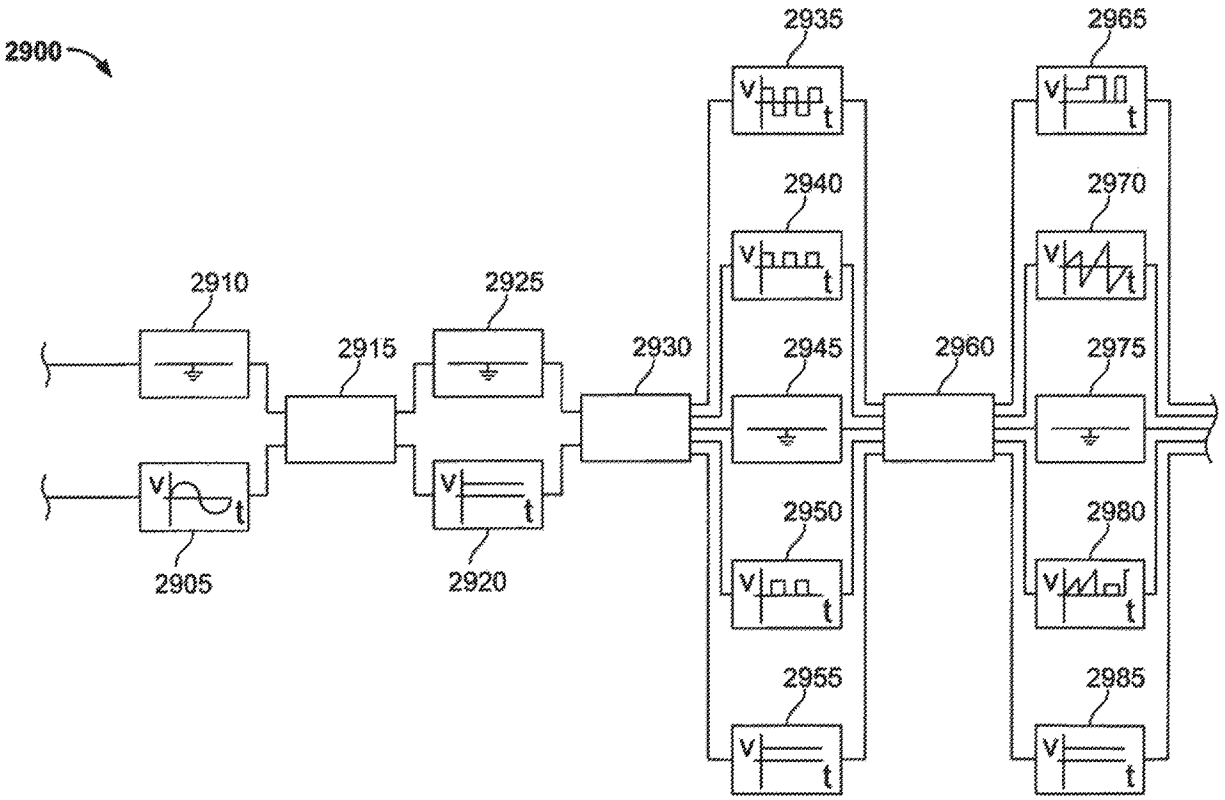
FIG. 20 depicts an exemplary multiple controller system.

To aid understanding, this document is organized as follows. First, exemplary couplings for a standardized interface are briefly introduced with reference to FIGS. 12-17. Second, FIG. 18 depicts a schematic view of an exemplary network architecture using the interface of FIG. 12, for example. Third, FIG. 19 depicts an exemplary controller implemented for outputting independent electrical excitation signals and FIG. 20 depicts an exemplary multiple controller system. Second, with reference to FIGS. 21-24, the discussion turns to components available for building a light string system enabled by the exemplary couplings of FIGS. 12-17. Finally, with reference to FIGS. 25 and 26, the discussion turns to exemplary embodiments of light string systems using the components of FIGS. 21-24.

Figure 12:
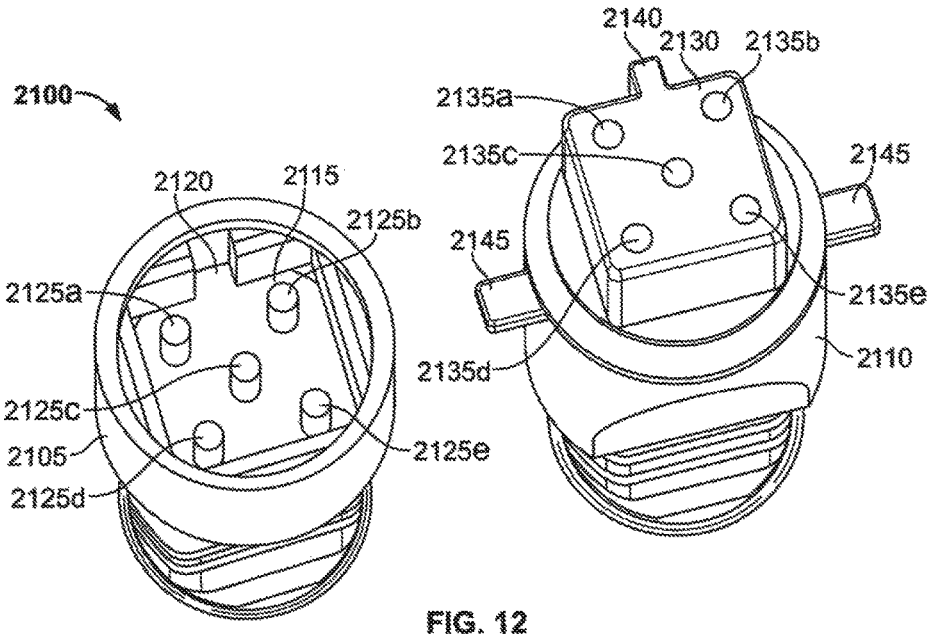
FIG. 12 depicts a perspective view of an exemplary multi-channel interface for coupling independent electrical excitation signals.

FIG. 12 depicts a perspective view of an exemplary multi-channel interface for coupling independent electrical excitation signals. Multi-channel couplings, such as three-channel couplings, may be used with multi-channel light strings, such as three-channel light strings, for example. A multi-channel coupling interface 2100 includes a first connector body or plug 2105 and a second connector body or socket 2110 that are adapted to cooperate. In various examples, the plug 2105 may be connected to the light strings or other downstream loads and the socket 2110 may be connected to an upstream excitation source. In some implementations, the upstream excitation source may include a power circuit (not shown) through intervening controller (not shown) and bus line (not shown). Electricity is input from the power circuit into the controller and output through the bus line to the light strings.

The plug 2105 includes a plug connecting face 2115 with plug contacts or channels 2125A-E. The plug connecting face 2115 is shown as a depression in the shape of a rectangle with rounded corners concentric within a circular frame. The plug connecting face 2115 includes an orienting notch 2120 connected to the depression. The plug channels 2115 are positioned within the depression. In some embodiments, the depression may be circular. In some embodiments, the frame may be rectangular.

The socket 2110 includes a socket connecting face 2130 with socket contacts or channels 2135A-E. The socket connecting face 2130 is shown as a protrusion in the shape of a rectangle with rounded corners positioned on a cylindrical support. The plug connecting face 2130 includes a projection 2140 connected to the protrusion. In some embodiments, the protrusion may be in the shape of a circle. In some embodiments, the support may be in the shape of a rectangular prism.

The socket 2110 may also include tabs 2145 extending laterally outward from the sides of the body to receive and hold a retaining cover as will be described in reference to FIGS. 14-17.

The notch 2120 and projection 2140 form a mating interface for mating together to ensure that the first connector body or plug 2105 and second connector body or socket 2110 connect in a predetermined and certain orientation such that specific plug contacts or channels 2125A-E align with certain respective socket contacts or channels 2135A-E.

The plug channels 2125A, B, E and the socket channels 2135A, B, E are channels for supplying independent electrical excitation signals to create different lighting effects at loads to be connected by the user. In some implementations, these channels can operate independently of each other. In some examples, for example in applications with high load current loads, the same electrical excitation source may be supplied to two or more of the channels, and the loads may be substantially balanced among the parallel paths by appropriate user selection of the relative orientations between each plug and socket. The plug channel 2125D and the socket channel 2135D form the steady power channel at which steady power may be accessed by light strings anywhere downstream from the controller.

In the depicted example, the plug channel 2125C and the socket channel 2135C form a common channel for forming a return path for each of the independent channels. In other embodiments, one or more common return paths may provide a separate return for two or more of the electrical excitation signal paths. In various embodiments, the at least one common channel may be arranged to be substantially oriented along or around an axis of symmetry for the interface. In the depicted example, the socket channel 2135C lies substantially along a central axis that is orthogonal to a plane defined between the plug and socket when engaged. In any relative orientation allowed in FIG. 12 or FIG. 14, as will be described, the corresponding common terminal(s) of the plug 2105 and the socket 2110 will properly register.

When the plug 2105 is connected with the socket 2110, the plug connecting face 2115 cooperates with the socket connecting face 2130. The notch 2120 cooperates with the projection 2140 to permit only a single valid registration. When the connecting faces 2115, 2130 cooperate, the plug channels 2125A-E connect with the corresponding socket channels 2135A-E.

Figure 13:
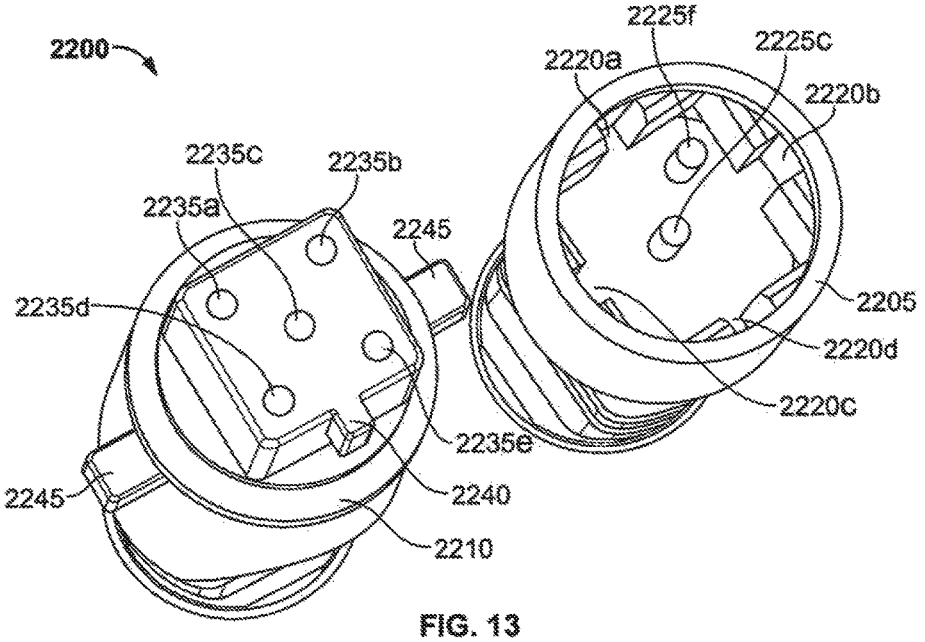
FIG. 13 depicts a perspective view of an exemplary single channel interface for coupling any of the available independent electrical excitation signals based on a relative orientation of the plug and socket.

FIG. 13 depicts a perspective view of an exemplary single channel interface for coupling any of the available independent electrical excitation signals based on a relative orientation of the plug and socket. A single channel coupling can be used with a single channel load, such as a light string or downstream controller module, for example. A single channel coupling 2200 includes a socket 2205 and a plug 2210. The plug 2210, which includes socket channels 2235A-E and projection 2240, has a similar configuration to that in FIG. 12. The socket 2205 includes socket channels 2225C, F and notches 2220A-D. When socket 2205 and plug 2210 are connected, the projection 2240 may cooperate with any of the notches 2220A-D. While socket channel 2220C is connected with plug channel 2235C, a user may select which plug channel 2235A, B, D, E connects with socket channel 2225F by positioning the projection 2240 to cooperate with notches 2220A, B, C, D. In some embodiments, the plug 2210 is rotated relative to the socket 2205 until the projection 2240 cooperates with desired notch 2220A, B, C, or D.

The projection 2240 may correspond to a mating structure on the socket 2210 and the notches 2220A-D may correspond to first, second, third, and fourth mating structures on the plug 2205. Depending on the mating interface that is utilized between the projection 2240 and notches 2220A-D the channel 2235A, B, D, E output may differ. In some examples, the channels 2235A, B, D, and E may each be electrically isolated to output a different or specific generated waveform predetermined for that specific channel 2235A, B, D, E. In another example, one of the channels 2235A, B, D, E may correspond to an on position and one of the channels 2235A, B, D, E may correspond to an off position. By way of example, and not limitation, the plug may have 2, 3, 5, 6, 7, or 8 notches, and a corresponding number of independent channels. In another example, the plug 2205 may have 3, 4, 5, or more channels to correspond with a similar number and orientation of channels of the socket 2210.

The socket 2210 may also include tabs 2245 extending laterally outward from the sides of the body to receive and hold a retaining cover as will be described in reference to FIGS. 14-17.

FIGS. 14, 15, 16, and 17 depict a perspective view of an exemplary assemblage and locking structure for a single or multi-channel interface.

Figure 14:
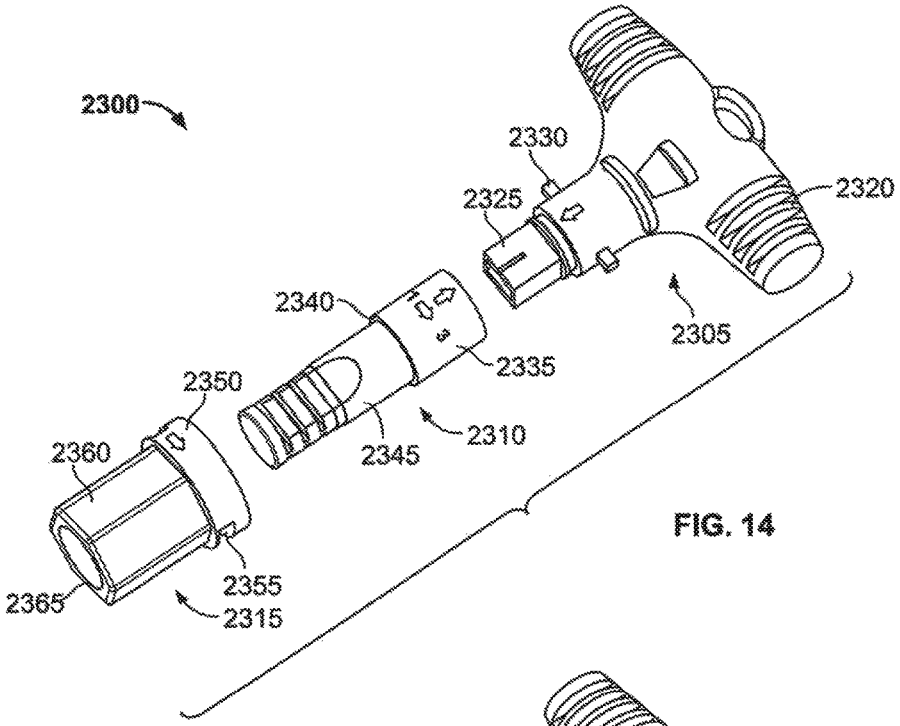
FIGS. 14, 15, 16, and 17 depict a perspective view of an exemplary assemblage and locking structure for a single or multi-channel interface.

FIG. 14 shows an exploded view of an exemplary assembly 2300. The assembly 2300 includes a first connector 2305, a second connector 2310, and a retaining cover 2315 that can be coupled to form a multi or single channel interface for one or more excitation signals. In various embodiments, the signals may be coupled together, for example, in a predetermined manner as described in reference to FIG. 12, or relative to an orientation of the coupled first connector 2305 and second connector 2310 as described in reference to FIG. 13.

The first connector 2305 includes a junction 2320, a socket 2325 having a plurality of channels, and outer tabs 2330. As shown in the exemplary first connector 2305, the junction 2320 comprises a T-shape. The second connector 2310 comprises a plug 2335 having a plurality of channels for mating with one or more of the channels of the socket 2325. Also shown in connection with the second connector 2310 is a ridge 2340 forming the base of the plug 2335 and an extended portion 2345 extending from the base 2340 opposite the plug 2335.

The retaining cover 2315 has a first portion 2350 at a forward end comprising a ring shape and having one or more retaining slots 2355 to correspondingly mate with and lock upon the tabs 2330 of the first connector 2305. Also included with the retaining cover 2315 is a second portion 2360 extending rearwardly of the first portion 2350 and forming an elongated ring shape having an opening 2365 extending through concentric with the first portion 2350 and for receiving the extended portion 2345 of the second connector 2310 and being retained thereupon.

Figure 15:
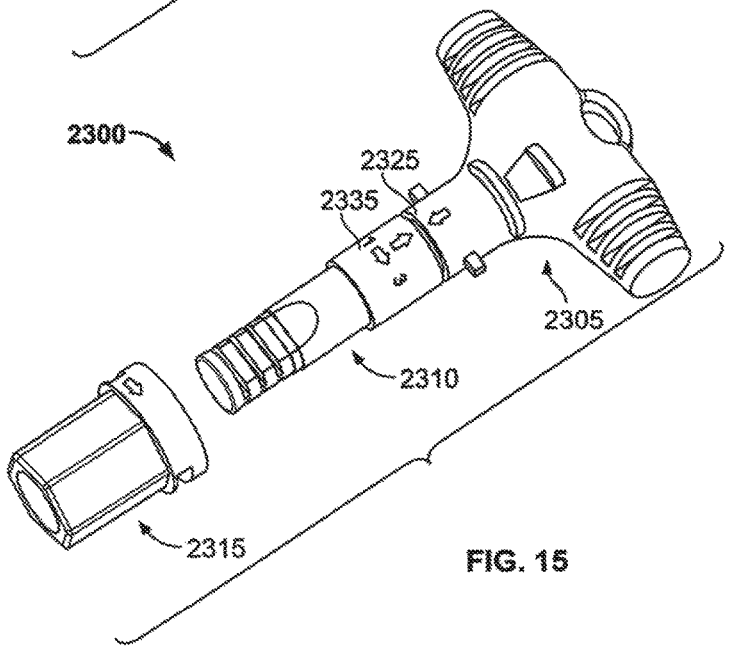

FIG. 15 shows the assembly 2300 of FIG. 14 in a next exemplary step of coupling, with the second connector 2310 coupled to the first connector 2305. The socket 2335 is connected to the plug 2325 such that corresponding channels of the socket and plug are connected (e.g., galvanically coupled, in fluid communication, in direct contact). In some embodiments, one or more of the corresponding channels may serve to conduct energy in the form of a generated electrical waveform. In some examples, one or more of the corresponding channels may serve to transfer a fluid therethrough such as, for example, water, a fluid, or a pressurized gas.

Figure 16:
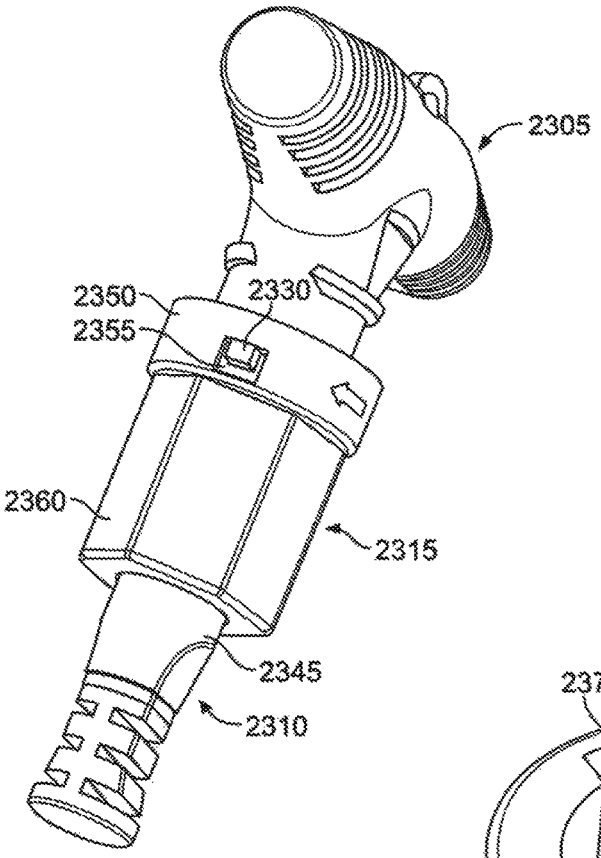

FIG. 16 shows the assembly 2300 of FIG. 14 in a next exemplary step of coupling after that described with reference to FIG. 15. In this example, the retaining cover 2315 is extended over the second connector 2310 such that the second portion 2360 receives the extended portion 2345 and is extended forwardly against the ridge 2340 such as to engage the ridge 2340 to stop forward movement of the retaining cover 2315. Also illustrated is the tab 2330 locked within the retaining slots 2355. The retaining slot 2355 is shown as having a tapering shape. In some examples the tab 2330 may be received within the wider portion of the slot 2355 and moved via rotation of the retaining cover 2315 to within the narrower portion of the slot 2355. In some examples, the retaining cover 2315 may be locked upon the first and second connectors 2305, 2310 via an insert and twist-lock manner.

Figure 17:
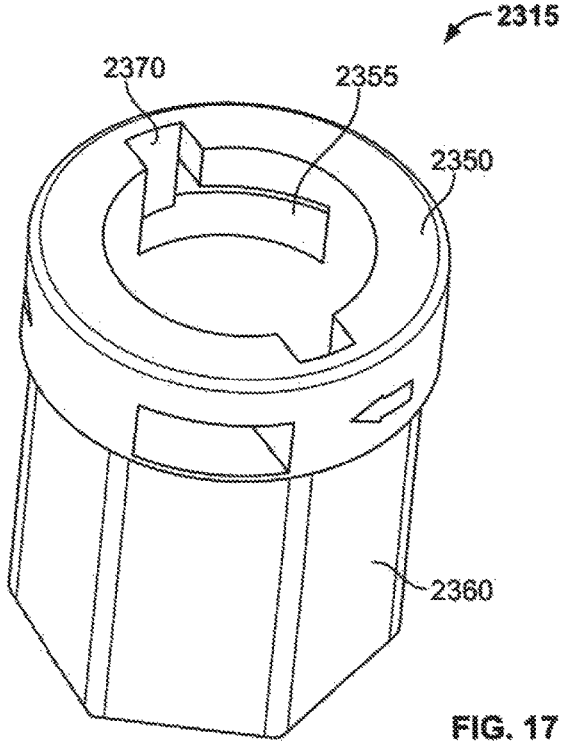

FIG. 17 illustrates an upper perspective view of the retaining cover 2315 described with reference to FIGS. 14-16. The retaining cover 2315 includes receiving slots 2370 along an outer face to receive the tabs 2330 subsequent to the tabs 2330 being locked and retained within the retaining slots 2355, wherein the receiving slots 2370 are in connection with a corresponding retaining slots 2355 to provide for a smooth transition of the tabs 2330 from the receiving slots 2370 to the retaining slots 2355.

FIG. 18 depicts a schematic view of an exemplary network architecture using the interface of FIG. 12. A light string system 2700 accepts electrical power from a power outlet 2705, transformer 2710. The transformer 2710 conditions the power, for example to low voltage for safety against shock, and delivers the conditioned power to a transformer socket 2715 and a coupling 2720. The coupling 2720 includes a coupling plug 2725 and a coupling socket 2730. Light strings 2735A-C are connected to the coupling 2720 via the coupling plug 2725. Light strings 2735A-C include sub-light strings 2740. Electrical excitation signals may be input from the power outlet 2705 into the transformer 2710 and out of the coupling 2720 and into the light strings 2735A-C. The transformer 2710 splits the power supply into four separate channels as shown by the coupling 2720 with five channels, one of which is the common channel at which different light strings may be connected.

As depicted in FIG. 18, the light strings 2735A-C are connected in parallel to one or more of the channels received at the plug 2725. Each of the light strings 2735A-C has one end connected to the common channel and an opposite end connected to one of the other channels. Light strings 2735A and 2735B each include 3 sub-light strings. Light string 2735C each include 4 sub-light strings. A controller using three channels may be used to create different lighting effects from each of the light strings. In some embodiments, the light strings can be controlled to flash at different frequencies, for example.

FIG. 19 depicts an exemplary controller 2800 implemented for outputting independent electrical excitation signals. The controller 2800 includes a DC input and a ground input that may lead to a power switch 2805 controlled by user input. In some embodiments an upstream controller 2800 may control operation of the power switch 2805. Output from the controller 2800 is a DC output and a ground output. The output DC voltage may be the same as the input DC voltage such that the DC passes-through the controller 2800 without being changed. In some embodiments, the power switch 2805 may be omitted.

The controller 2800 also includes a processor 2810 (e.g., CPU), random access memory (RAM) 2815, non-volatile memory (NVM) 2820 having which may have embedded code 2825, and a communications port 2830. The processor 2810 may execute code 2825 to perform various digital or analog control functions. The processor 2810 may be a general purpose digital microprocessor 2810 which controls the operation of the controller 2800. The processor 2810 may be a single-chip processor 2810 or implemented with multiple components. Using instructions retrieved from memory, the processor 2810 may control reception and manipulations of input data and the output data or excitation signals. RAM may be used by the processor 2810 as a general storage area and as scratch-pad memory, and can also be used to store input data and processed data.

The exemplary controller 2800 also includes a user interface 2840 controlled by user input and an analog interface 2845 controlled by analog input. The user interface 2840 may include dials, such as for example timing dials, frequency dials, or amplitude control dials. The user interface 2840 may include switches or control buttons, such as for example amplitude changing controls, channel changing controls, or frequency changing controls. The user interface 2840 and the analog interface 2845, as well as the processor 2810, memory, and communications are connected to a control module 2850.

A communications network 2835 may communicate with the communications port 2830 and may be utilized to send and receive data over a network 2835 connected to other controllers 2800 or computer systems. An interface card or similar device and appropriate software may be implemented by the processor 2810 to connect the controller 2800 to an existing network 2835 and transfer data according to standard protocols. The communications network 2835 may also communicate with upstream or downstream controllers 2800, such as for example to activate or deactivate upstream or downstream controllers 2800. In some embodiments, the communications network 2835 is suited for routing a master-slave command to downstream controller 2800. In the embodiment, the controllers 2800 include suitable circuitry for interpreting the master-slave command. Commands sent to upstream or downstream controllers 2800 may be sent through power line carrier modes, optical (e.g., infrared, visible), sound (e.g., audible, ultrasonic, subsonic modulation), or wireless (e.g., Bluetooth, Zigbee) modes, for example.

The exemplary control module 2850 includes a plurality of function generators 2855, 2860, 2865 each for outputting one or more predetermined or user-configured waveforms to a corresponding channel. The function generators 2855, 2860, 2865 may operate independently of one another or together. The function generators 2855, 2860, 2865 may receive pre-stored data for outputting predetermined waveforms or may receive user-configured data from user input to generate unique and customizable waveforms. In some embodiments, the waveforms generated may be electrical waveforms which control and regulate output lumens from one or more lights upon a light string. In some examples, the control module 2850 may also include a switch timing control 2870 which may use a duty cycle to generate control signals for use by the function generators 2855, 2860, 2865. In some embodiments, the control signals may be timed to draw specific current waveforms at specific intervals.

In some embodiments, the waveforms generated by the function generators 2855, 2860, 2865 may comprise one or more frequencies. In some embodiments, the waveforms generated may cause a blinking effect among the connected lights. In some embodiments, the waveforms generated may cause a steady-on effect among the connected lights. In some embodiments, the waveforms generated may cause a dimming effect among the connected lights. In some embodiments, the waveforms generated may cause a dimming effect followed by a steady-on effect among the connected lights. In some embodiments, the waveforms generated may cause a blinking effect followed by a dimming effect followed by a steady-on effect among the connected lights.

FIG. 20 depicts an exemplary multiple controller system. In a multiple controller system 2900 as depicted in FIG. 20, each signal voltage vs. time waveform is shown in graphical format at the various stages in the system 2900. In a first stage, a sinusoidal AC input 2905 and common or ground 2910 are shown coupled to a transformer for conditioning the signal and converting the AC signal to a DC format. In some embodiments, other half-wave or full-wave rectifiers may be used for conversion of the AC signal into a DC signal. In some embodiments, the AC signal is converted into a DC (e.g., substantially unipolar) signal with amplitude of, for example, about 9, 12, 15, 18, 21, 24, 27, 30, 34, 38, 42, or up to at least about 60 volts. In some examples, the DC signal may be considered to be safety extra low voltage (SELV) or otherwise provide substantial protection against hazardous electrical shock.

In the second stage, the DC power 2920 and ground 2925 are shown leading to a first controller 2930. In some applications, the controller 2930 may include various features of the controller 2800 described with reference to FIG. 19.

In the third stage, a DC power 2955 and a ground 2945 continue such that the DC power and ground are passed-through the first controller 2930 so that the DC voltage output from the controller 2930 may be substantially the same as the DC voltage input to the first controller 2930. A plurality of waveforms are generated by the controller 2930 and output to a first channel 2935, a second channel 2940, and a third channel 2950. In the exemplary first channel waveform 2935 is output that generates a color-flipping sequence by two or more lights (e.g., anti-parallel diode circuits), such that a first color light and a second color light are alternately activated upon a single channel light string in response to corresponding alternate polarities of current through the light string. In the exemplary second channel 2940, an on/off waveform is generated such as to cause a blinking effect among the lights. In the exemplary third channel 2950, an on/off waveform is generated such as to cause a blinking effect among the lights. The waveform of the third channel 2950 is depicted as delayed with respect to the waveform of the second channel 2940 such that the signals of the two channels are 180 degrees out of phase (e.g., when the third channel is in an on state the second channel may be in an off state). Depending on the duty cycles, in this example, the on-times between the channels 2940, 2950 may overlap, or there may be dark periods when both of the channels 2940, 2950 are off.

In the fourth stage, a DC power 2985 and a ground 2975 continue such that the DC power and ground are passed-through a second controller 2960 so that the DC voltage output from the controller 2960 is substantially the same as the DC voltage input to the controller 2960. A plurality of waveforms are generated by the controller 2960 and output to a first channel 2965, a second channel 2970, and a third channel 2975. In the exemplary first channel 2965 a waveform is output that generates a first amplitude or corresponding light brightness, followed by a second amplitude or corresponding light brightness, followed by an off state, and then followed by an on state. In the exemplary second channel 2970 a waveform is output that generates a dimming as well as a color-flipping pattern. In the exemplary third channel 2975 a waveform is output that generates a dimming effect as well as an on/off effect.

In some embodiments, the controller 2800, for example, may include an attenuator or gain circuit capable of supplying any of a plurality of values in a range between a maximum voltage and the common, or a maximum voltage line-to-line among any two of the channels, of either positive or negative polarity. For example, a wide range of analog output voltages or controlled current sources may be formed by various circuit subsystems, including without limitation, one or more of a boost, Cuk, SEPIC, Flyback, forward, buck, buck-boost converter, or an amplifier (e.g., class A, B, C, D), or equivalents thereto, taken alone or in combination, and regulated with an open-loop or closed-loop controller (e.g., voltage mode and/or current mode).

Figure 21:
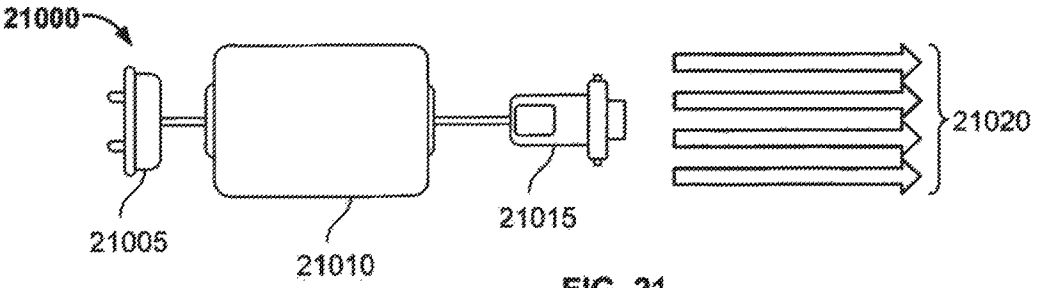
FIGS. 21, 22, and 23 depict views of exemplary transformers and controllers with associated input and output connectors.
Figure 22:
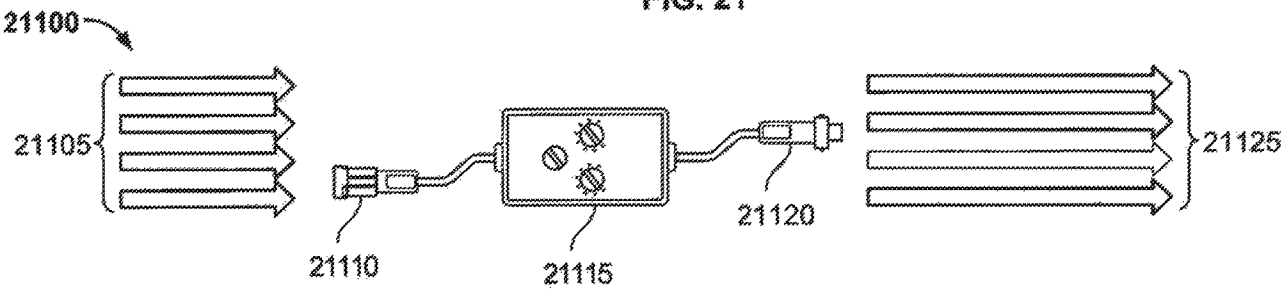
Figure 23:
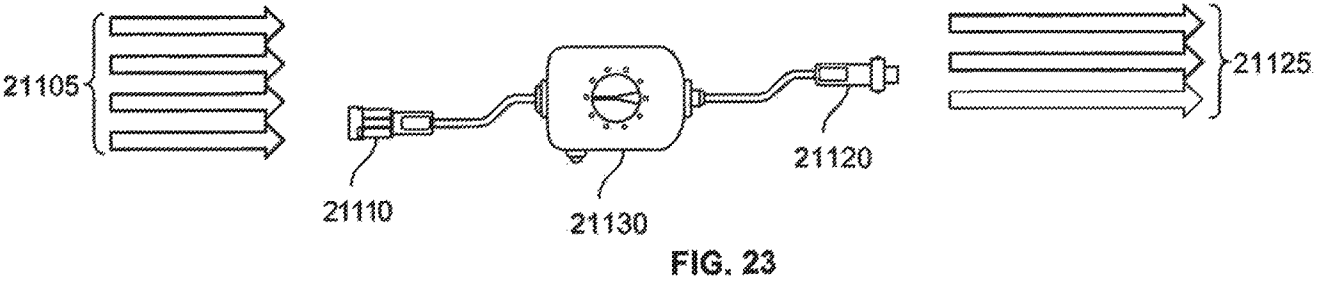

FIGS. 21, 22, and 23 depict views of exemplary transformers and controllers with associated input and output connectors. FIG. 21 depicts a system 21000 having an AC plug 21005, a transformer 21010 for conditioning the input power and converting to a DC signal, and an output connector 21015. The output connector 21015 outputs a plurality of channels of DC voltage 21020. In the exemplary Figure, the connector 21015 outputs 4 channels of DC voltage. The DC voltage may be advantageously split into multiple parallel channels to reduce voltage drop in the line.

FIG. 22 depicts a system 21100 for receiving a plurality of channels of DC power 21105 via a connector 21110, and then to a three-channel ten-function controller 21115. In some embodiments, the connector 21110 may connect to a connector downstream of a transformer, such as the transformer 21010. On its output, the controller 21115 supplies three channels to create different lighting effects with each channel operating independently of the other two. The controller 21115 routes the 4 channels of DC input power received via the connector 21110 to a single output DC channel, for example, as a pass-through.

The controller 21115 may have various types and configurations of circuitry to generate or perform various functions. Some exemplary functions include steady on, single bulb chase and two bulb chase. The controller 21115 may also include fading functions to fade lights to a lower lumen output where functions may include single bulb fade or two bulb fade. The controller 21115 may also include functions for causing lights to flash, twinkle, sequential fade in fade out, all fade, and fade to dim. In addition, the controller 21115 may have speed settings to control a rate that the excitation signal amplitude lowers and corresponding lights dim. As shown in FIG. 22, the DC power and 3 waveform channels are output through another connector 21120.)

All connectors may comprise easy, modular, quick connect-disconnect connectors. Some implementations may include connectors having waterproof construction (e.g., IP-65 rating or the like) that are capable of submerged operation.

FIG. 23 depicts an example of an exemplary three-channel, eight-function controller. As depicted, a controller 21130 uses three channels to create different lighting effects with each channel operating independently of the other two. The controller 21130 may include circuitry to perform similar or dissimilar functions as that described in reference to FIG. 22. In addition, user input controls may differ or be similar among different types of controllers as illustrated in FIGS. 22 and 23. In FIG. 23, some functions for lighting effects may include steady-on, combination, in waves, sequential, slo-glo, chasing/flashing, slowfade, and twinkle/flash. More or less channels may be output and/or activated via the controllers than that illustrated.

Figure 24:
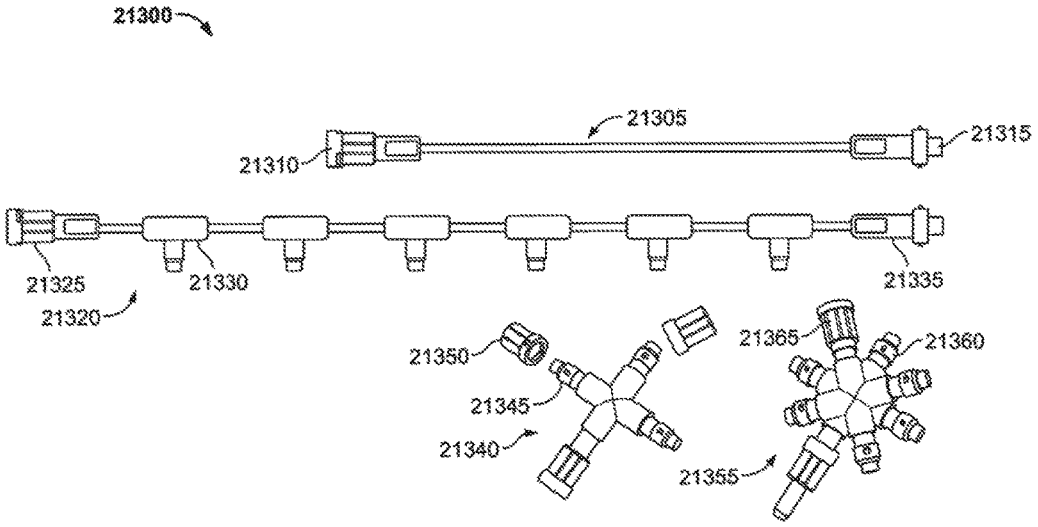
FIG. 24 depicts views of exemplary components for implementing a light string system.

FIG. 24 depicts views of exemplary components for implementing a light string system. The components 21300 include a coupling extension cord 21305 with a plug 21310 at one end and a socket 21315 at the other end. A mother or bus line 21320 includes a plug 21325 at one end, a socket 21335 at one other end, and several T-taps 21330 with socket ends in between.

Various exemplary splitters incorporating couplings are also illustrated. A first splitter 21340 includes a four-way splitter with four sockets 21345 and four plugs 21350. A second splitter 21355 includes an eight-way splitter with eight sockets 21360 and eight plugs 21365 is illustrated.

Figure 25:
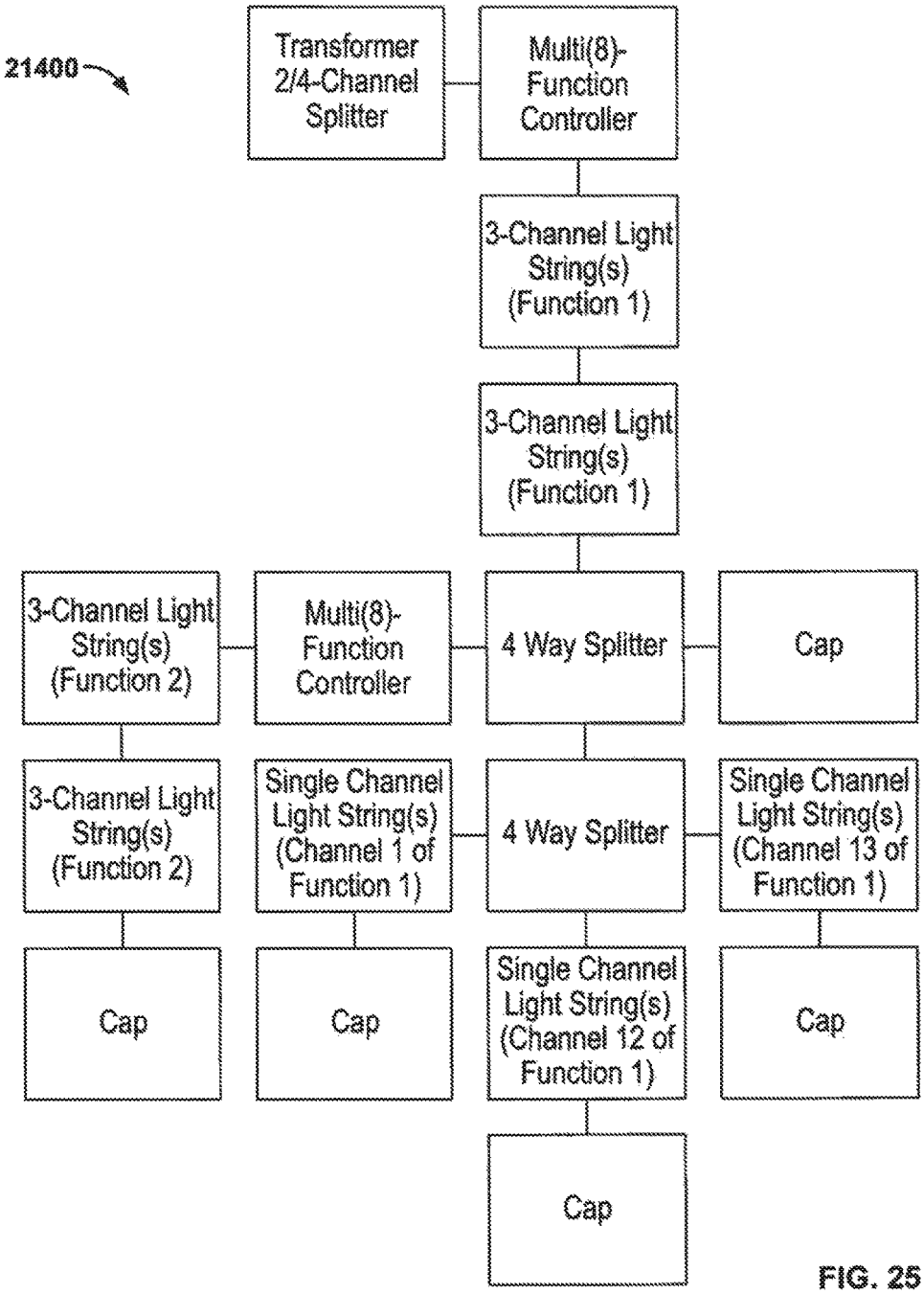
FIG. 25 depicts a block diagram of an exemplary arrangement of the components of FIGS. 21-24 in a light string system.

FIG. 25 depicts a block diagram 21400 of an exemplary arrangement of the components of FIGS. 21-24 in a light string system.

Figure 26:
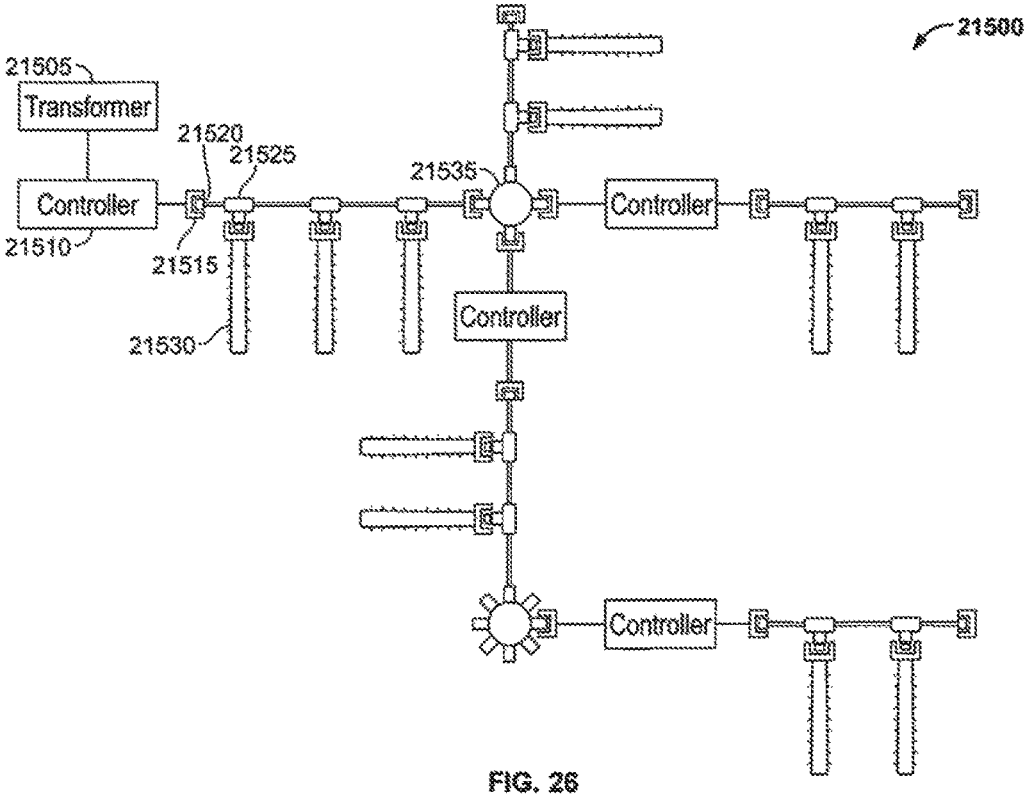
FIG. 26 depicts a schematic representation of another exemplary arrangement of the components of FIGS. 21-24 in a light string system.

FIG. 26 depicts a schematic representation of another exemplary arrangement of the components of FIGS. 21-24 in a light string system. As depicted, a system 21500 may include a transformer 21505, a controller 21510, a plug 21515 and socket 21520 coupling, as well as multiple T-taps 21525 for connecting to light strings 21530, and splitters 21535 for sectionalizing light strings and controllers. The user may create different light string systems with light strings working off different controllers either in a multi-channel or single channel effect. The transformer can be used to power light string loads and/or downstream controllers. End caps may be included to at a terminal end of a network branch to provide, for example, a protective covering for electrical safety.

Although various embodiments have been described with reference to the Figures, other embodiments are contemplated. For example, a low voltage transformer may split the power supply into 4 separate channels. Some coupling designs may include five nodes, each of which may be connected by a connector holes/pin pairs. One of the nodes is for electrical common (e.g., return path) and 4 of the nodes are for independently driven separate channels.

Some embodiments may include multiple common or return conductors. The conductors may be symmetrically arranged to permit coupling in any permitted relative orientation between socket and plug, examples of which are described with reference to at least FIG. 13, for example.

In an illustrative example, one channel may be designated as Steady Power, where one can access steady power anywhere downstream in the network configuration, even if one or more so-called Function Controllers were implemented upstream in the network.

An exemplary function of some embodiments of the described Low Voltage Coupling system may be to employ "Function Controller(s)" to create a lighting effect. The Function Controller may use, for example, 3 Channels (1-3) to create different lighting effects; each channel operating independently to the other two. In some embodiments, a downstream channel may carry a similar electrical waveform as an upstream channel. In other embodiments, a downstream channel may carry a different electrical waveform than an upstream channel.

When using 3-channel Light Strings/Products (e.g., each light string/product actually has three separate light strings in-line, each on a separate channel) there may be only one possible orientation for connecting the male and female couplers (e.g., see Multi-Channel Configuration described with reference to FIG. 12). In other embodiments, there may be multiple orientations for connecting a male and female connector, such as for example in a 90 degree orientation, 180 degree orientation, and a 270 degree orientation relative one another (e.g., see description with reference to FIG. 13).

When using single-channel light strings, the coupler design (see, e.g., single-channel dial-in configuration) may advantageously allow the user to choose which channel he/she wants to connect to; one of the function controlled channels or the steady-power channel. The user may put together multiple lighting arrays, each potentially working off a different controller, and each working in either multi-channel or single channel effect.

In some embodiments, the lighting units may include circuitry to output a first and a second color in simultaneous or an alternating manner. For example, a first light may output a first color and a second light may output a second color. The first light and the second light may be connected to the same channel or may be connected to different channels. In one embodiment, the first light corresponds to a first diode arranged in a first direction and a second light corresponds to a second diode arranged in a second direction on the same channel as the first diode to result in the color flipping output pattern. In some embodiments, the diodes may be arranged in a parallel orientation and connected along the same channel.

In some embodiments, multiple controllers may have circuitry to function in a master-slave configuration. For example, a first controller may function as a master controller and a second controller may function as a slave controller. In some embodiments, the master controller may send signals to the slave controller through the steady-state DC power line to dictate the generated waveforms by the function generator of the second controller. For example, a user may configure a first controller which in turn may configure multiple downstream controllers. In some embodiments, a singular master controller may control 2, 3, 4, 5, or 6 downstream slave controllers. In other embodiments, multiple master controllers may be used to control their corresponding slave controllers. Control signals may be sent between master and slave controllers, such as for example by a power line carrier method. In other embodiments, wireless transmission may be used to send and receive control signals and commands.

In some examples, the controller may have circuitry and/or embedded or user-configured code to control the speed at which connected lights dim, blink on and off. In some embodiments, timing features of the controller circuitry may provide for chasing displays of the lights where the lights are activated sequential to create the chasing effect. In some embodiments, the controller may include inputs for receiving audible commands, such that the function generator outputs frequencies and waveforms corresponding to an input audible command, such as for example a song or a voice. In some embodiments, the controller may include tactile inputs such that the function generator outputs waveforms corresponding to a touch or motion of the controller. For example, the light strings may activate when the controller is touched and deactivate when the controller is touched again. In some embodiments, code or commands may be loaded onto the controller via a USB or wireless device for waveform output.

In some embodiments the controller may be supplied with a high DC power suitable for outputting a plurality of steady-on channels. In other embodiments, the controller may be supplied with a lower DC power that would not be suitable for outputting steady power channels in some or all of the output channels. For example, the controller may only be able to output waveforms which cause alternating blinking effects based on current supply limitations, for example.

The system may be used in various applications. In some embodiments, the system may be used in submersible environments to provide underwater lighting. Each of the devices, including the controller, connectors, transformer, and light strings may be constructed to be waterproof. In some embodiments, the system may be used in marine and/or aircraft vessels. In other embodiments, the system may be used as holiday lighting or landscape lighting. In some embodiments, the system including the controller, plug, socket, and connectors may be formed of a plastic material resistant to water penetration, UV effects, and other deteriorating causes.

In some embodiments, the controller may output electrical waveforms for being received by electrical devices other than lights or light strings. For example, the electrical waveforms may be transmitted to an audible device to cause the audible device to output a particular frequency. In other embodiments, the waveforms other than electrical waveforms may be generated and output by the controller. For example, a regulation of a fluid, such as water or gas, may be controlled by the controller and output to the independent channels in a particular frequency, timing, and/or volume.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. An apparatus, the apparatus comprising:

a load connector body having a connection face that is substantially square and protrudes from the load connecter body, wherein the load connection face comprises a load connector alignment feature formed with the load connection face;

a load common channel disposed substantially in a center of the load connection face;

a load power channel disposed on the load connection face at a predetermined radial distance from the load common channel, and adapted to carry operating power; and, a plurality of load signal channels disposed on the load connection face at the predetermined radial distance from the load common channel, each of the plurality of load signal channels is adapted to carry independent control signal information, wherein the load connector body is configured to pluggably couple to a first supply connector body comprising a first supply common terminal, a first supply power terminal, a first plurality of supply output terminals, and a first supply connector alignment feature configured to align to the load connector alignment feature such that the load power channel aligns with the first supply power terminal when the load connector is pluggably coupled to the first supply connector body; and, wherein the load connector body is configured to pluggably couple to a second supply connector body comprising a second supply common terminal, a second supply power terminal, a second plurality of supply output terminals, a second supply connector alignment feature and a third supply connector alignment feature, wherein the second connector alignment feature is configured to align to the load connector alignment feature such that the load power channel aligns with the second supply power terminal when the load connector body is pluggably coupled to the second supply connector body, and the third connector alignment feature is configured to align to the load connector alignment feature such that the load power channel aligns with a first one of the second plurality of supply output terminals when the load connector body is pluggably coupled to the second supply connector body.

2. The apparatus of claim 1, wherein the independent control signal information is for independently controlling light strings.

3. The apparatus of claim 1, the second supply connector body further comprising a fourth supply connector alignment feature.

4. The apparatus of claim 3, wherein the fourth connector alignment feature is configured to align to the load connector alignment feature such that the load power channel aligns with a second one of the second plurality of supply output terminals when the load connector body is pluggably coupled to the second supply connector body.

5. The apparatus of claim 1, wherein the operating power comprises a unipolar voltage.

6. The apparatus of claim 1, wherein the operating power comprises an alternating polarity voltage.

7. The apparatus of claim 1, the second supply connector body further comprising a fifth supply connector alignment feature.

8. The apparatus of claim 7, wherein the fifth connector alignment feature is configured to align to the load connector alignment feature such that the load power channel aligns with a third one of the second plurality of supply output terminals when the load connector body is pluggably coupled to the second supply connector body.

9. The apparatus of claim 1, wherein at least one of the first plurality of supply output terminals supplies at least one of the plurality of load signal channels with the independent control signal information.

10. The apparatus of claim 1, wherein at least two of the second plurality of supply output terminals supply at least two of the plurality of load signal channels with at least two distinct independent control signal information.

11. A lighting system comprising:

a load connector body having a connection face that is substantially square and protrudes from the load connecter body, wherein the load connection face comprises a load connector alignment feature formed with the load connection face;

a load common channel disposed substantially in a center of the load connection face;

a load power channel disposed on the load connection face at a predetermined radial distance from the load common channel, and adapted to carry operating power; and, a plurality of load signal channels disposed on the load connection face at the predetermined radial distance from the load common channel, and adapted to carry independent control signal information for independently controlling light strings, wherein the load connector body is configured to pluggably couple to a first supply connector body comprising a first supply common terminal, a first supply power terminal, a first plurality of supply output terminals, and a first supply connector alignment feature configured to align to the load connector alignment feature such that the load power channel aligns with the first supply power terminal when the load connector is pluggably coupled to the first supply connector body; and, wherein the load connector body is configured to pluggably couple to a second supply connector body comprising a second supply common terminal, a second supply power terminal, a second plurality of supply output terminals, a second supply connector alignment feature and a third supply connector alignment feature, wherein the second connector alignment feature is configured to align to the load connector alignment feature such that the load power channel aligns with the second supply power terminal when the load connector body is pluggably coupled to the second supply connector body, and the third connector alignment feature is configured to align to the load connector alignment feature such that the load power channel aligns with a first one of the second plurality of supply output terminals when the load connector body is pluggably coupled to the second supply connector body.

12. The system of claim 11, the second supply connector body further comprising a fourth supply connector alignment feature.

13. The system of claim 12, wherein the fourth connector alignment feature is configured to align to the load connector alignment feature such that the load power channel aligns with a second one of the second plurality of supply output terminals when the load connector body is pluggably coupled to the second supply connector body.

14. The system of claim 11, wherein the operating power comprises a unipolar voltage.

15. The system of claim 11, wherein the operating power comprises an alternating polarity voltage.

16. The system of claim 11, wherein at one of the first plurality of supply output terminals supplies at one of the plurality of load signal channels with the independent control signal information.

17. A system for independently controlling lighting strings comprising:

means for pluggably coupling a first load connector body to a supply connector body, wherein the pluggable coupling means is configured to pluggably couple to a first supply connector body comprising a first supply common terminal, a first supply power terminal, a first plurality of supply output terminals, and a first supply connector alignment feature configured to align to a load connector alignment feature formed in the pluggable coupling means such that a load power channel provided in the pluggable coupling means aligns with the first supply power terminal when the pluggable coupling means is pluggably coupled to the first supply connector body, and wherein the pluggable coupling means is configured to pluggably couple to a second supply connector body comprising a second supply common terminal, a second supply power terminal, a second plurality of supply output terminals, a second supply connector alignment feature and a third supply connector alignment feature, wherein the second connector alignment feature is configured to align to the load connector alignment feature such that the load power channel aligns with the second supply power terminal when the pluggable coupling means is pluggably coupled to the second supply connector body, and the third connector alignment feature is configured to align to the load connector alignment feature such that the load power channel aligns with a first one of the second plurality of supply output terminals when the pluggable coupling means is pluggably coupled to the second supply connector body.

18. The system of claim 17, wherein the second supply connector body further comprises a fourth connector alignment feature configured to align to the load connector alignment feature such that the load power channel aligns with a second one of the second plurality of supply output terminals when the pluggable coupling means is pluggably coupled to the second supply connector body.

19. The system of claim 18, wherein the second supply connector body further comprises a fifth connector alignment feature configured to align to the load connector alignment feature such that the load power channel aligns with a third one of the second plurality of supply output terminals when the pluggable coupling means is pluggably coupled to the second supply connector body.

20. The system of claim 17, wherein the pluggable coupling means supplies an independent control signal information to at least one of the first plurality of load signal channels.

* * * * *